US008721068B2

(12) United States Patent
Yamasaki

(10) Patent No.: US 8,721,068 B2
(45) Date of Patent: May 13, 2014

(54) NAIL PRINT APPARATUS

(75) Inventor: Shuichi Yamasaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 179 days.

(21) Appl. No.: 13/315,668

(22) Filed: Dec. 9, 2011

(65) Prior Publication Data

US 2012/0147113 A1 Jun. 14, 2012

(30) Foreign Application Priority Data

Dec. 10, 2010 (JP) ..... 2010-275258
Mar. 31, 2011 (JP) ..... 2011-079684

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS 5,931,166 A * 8/1999 Weber et al. ..... 132/73
6,336,694 B1 * 1/2002 Ishizaka ..... 347/2

FOREIGN PATENT DOCUMENTS

JP 2000-194838 A 7/2000
JP 2006255196 A 9/2006

OTHER PUBLICATIONS

Japanese Office Action dated Jan. 8, 2013 (and English translation thereof) in counterpart Japanese Application No. 2011-079684.

* cited by examiner

*Primary Examiner* — Stephen Meier
*Assistant Examiner* — Alexander C Witkowski
(74) *Attorney, Agent, or Firm* — Holtz, Holtz, Goodman & Chick, PC

(57) ABSTRACT

Disclosed is a nail print apparatus including a printing finger fixation section which fixes a printing finger and a printing section, and the printing finger fixation section includes at least on finger insertion member which is provided so as to slide along a finger inserting direction according to a length of the printing finger when the printing finger is inserted, and the finger insertion member includes a nail portion exposure window which is provided for exposing the nail portion in a side of the printing section, a finger pressing section for pressing a vicinity of a base of the nail portion from above when the printing finger is inserted, and an abutment member which is arranged in a back side in the finger inserting direction than the nail portion exposure window so that a tip portion of the printing finger abuts when the printing finger is inserted.

13 Claims, 25 Drawing Sheets

NAIL PRINT APPARATUS

BACKGROUND OF THE INVENTION

1. Field of the Invention

The present invention relates to a nail print apparatus.

2. Description of Related Art

Nail print apparatus is a printing apparatus which performs printing on a nail of a printing finger, wherein the printing finger which is a finger including the nail to which printing is to be performed being placed on a mounting table provided in the apparatus main body.

However, when the printing finger is merely placed on the mounting table, there is a possibility that the printing finger may move due to movements of the hand and arm transmitting to the printing finger because the hand is in an unstable state. When the printing finger moves during printing causing the position of the printing finger to shift, graphics cannot be printed accurately on the nail, thus causing printing error to occur.

Further, when printing is performed in an inkjet method, for example, graphics cannot be printed finely because ink cannot be applied to correct positions when the printing head of the printing device and the nail are too far apart from each other. On the other hand, when the printing head and the nail are too close to each other, there is a possibility that the nail and finger may be smeared or the printing head may break due to the nail and finger contacting the printing head.

Therefore, it is necessary to decide and fix the position of the printing finger to an appropriate position so that the positional relation (distance and so forth) between the finger nail and the print head be in such way to protect both of the finger nail and the printing head and to enable fine printing.

In view of the above, conventionally, there is known a nail print apparatus in which a printing finger is placed at the position for placing a finger which is fixed in the apparatus and the printing finger is fixed with a restraining device such as a holder or the like so that the printing finger will not move, as shown in JP 2000-194838.

However, human fingers have different lengths according to each finger, from thumb to little finger. Further, length of a specific finger can vary among individuals. Therefore, when trying to perform printing to a plurality of fingers in one apparatus or when a plurality of users are to used one apparatus, there is a case where fingers cannot be sufficiently fixed because the size of the restraining device does not match when trying to fix the finger using the same restraining device. In such case, there is a problem that a proper printing cannot be performed due to the finger and nail rising or being shifted during printing and the like.

In a conventional method, a plurality of restraining devices corresponding to finger sizes of a plurality of users need to be prepared when the nail print apparatus is commercially used. Even when the apparatus is privately used, a plurality of restraining devices corresponding to all types of fingers are required. Further, when the nail print apparatus is privately used, even when a restraining device fitted for fingers of a user, family and friends of the user may also wish to use the same apparatus. However, in such case, there may be inconvenience that the same apparatus cannot be used when sizes of fingers do not match with the sizes of fingers of the user.

Moreover, including such variations of restraining devices to the nail print apparatus causes the cost of the apparatus to increase.

Supposedly, even when a restraining device is prepared for each user, there is a problem that selecting an appropriate restraining device which matches fingers of each user can be time consuming and costly.

Further, in the conventional case where a restraining device is used, fingers need to be fixed to a fixation restraining device in advance when performing printing to nail portions. Thus, the preparation before printing is greatly time consuming.

In view of the above problems, an object of the present invention is to provide a nail print apparatus which can prevent shifting and rising of fingers, corresponding to fingers of various lengths, in a simple manner and which can perform a fine printing to nail portions.

SUMMARY OF THE INVENTION

In order to solve the above problems, a nail print apparatus according to one aspect of the present invention includes a printing finger fixation section which fixes a printing finger which is a finger of a nail portion on which printing is to be performed and a printing section which performs printing to the nail portion of the printing finger which is fixed in the printing finger fixation section, and the printing finger fixation section includes at least on finger insertion member which is provided so as to slide along a finger inserting direction according to a length of the printing finger when the printing finger is inserted, and the finger insertion member includes a nail portion exposure window which is provided for exposing the nail portion in a side of the printing section, finger pressing section for pressing a vicinity of a base of the nail portion from above when the printing finger is inserted, the finger pressing section being disposed in a front side in the finger inserting direction than the nail portion exposure window and an abutment member which is arranged in a back side in the finger inserting direction than the nail portion exposure window so that a tip portion of the printing finger abuts when the printing finger is inserted.

According to the present invention, the finger insertion member slides to a position corresponding to the length of the printing finger even when a finger of any length is inserted as the printing finger and the nail portion is exposed from the nail portion exposure window in the side of printing section. And further, vicinity of the base of the nail portion van be pressed by the finger pressing section from above.

Therefore, by a simple manner of respectively inserting the printing fingers in the finger insertion members, the printing fingers can be prevented from bending upward while fixing the nail portions of the printing finger at positions near the printing section as much as possible, and nail printing can be performed accurately to the nail portion by the printing section. Further, breaking of the printing section due to the printing section and the printing fingers contacting each other and attaching of ink ant the like to the printing fingers can be prevented for sure. Moreover, because vicinity of the based of the nail portion be in a state covered with the finger pressing section, ink and the like can be prevented from attaching to fingers even when ink scatters from the printing section in vicinity of the bases of the nail portions.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

First Embodiment

Figure 1:
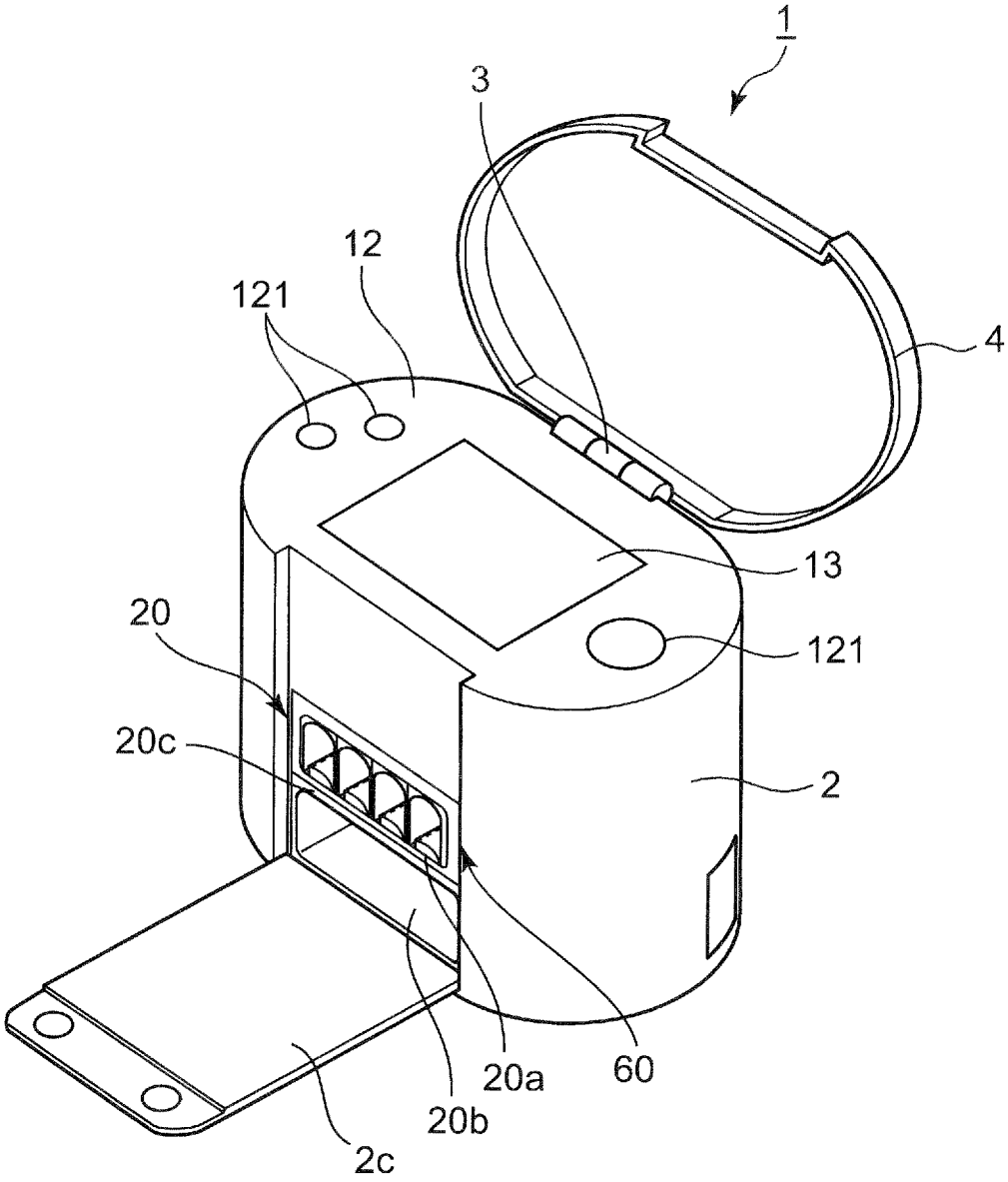
FIG. 1 is a schematic view conceptually showing an embodiment of a nail print apparatus according to the present invention, wherein a cover is opened.

First, the first embodiment of a nail print apparatus according to the present invention will be described with reference to FIGS. 1 to 9. Note that the scope of the present invention will not be limited to the examples shown in the drawings.

FIG. 1 is a schematic view showing an outer view of the nail print apparatus of this embodiment.

As shown in FIG. 1, the nail print apparatus 1 includes a case body 2 and a cover 4. The case body 2 and the cover 4 are joined to each other via a hinge 3 provided at the upper surface back end portion of the case body 2.

The case body 2 is formed in an oval shape in a plan view. An open/close plate 2*c* which can rise and fall is provided on the front of the case body 2. The open/close plate 2*c* is joined to the case body 2 via a hinge (not shown in the drawing) provided on the front surface at lower end portion of the case body 2. The open/close plate 2*c* is to open and close the front side of the case body 2.

Moreover, the after-mentioned operation section 12 is disposed on the top board 2*f* of the case body 2, the top board 2*f* being arranged on the upper surface of the case body 2, and a display section 13 is disposed at an approximately center of the top board 2*f*.

Here, shapes and configurations of the case body 2 and the cover 4 are not limited to the above illustrated example.

Figure 2:
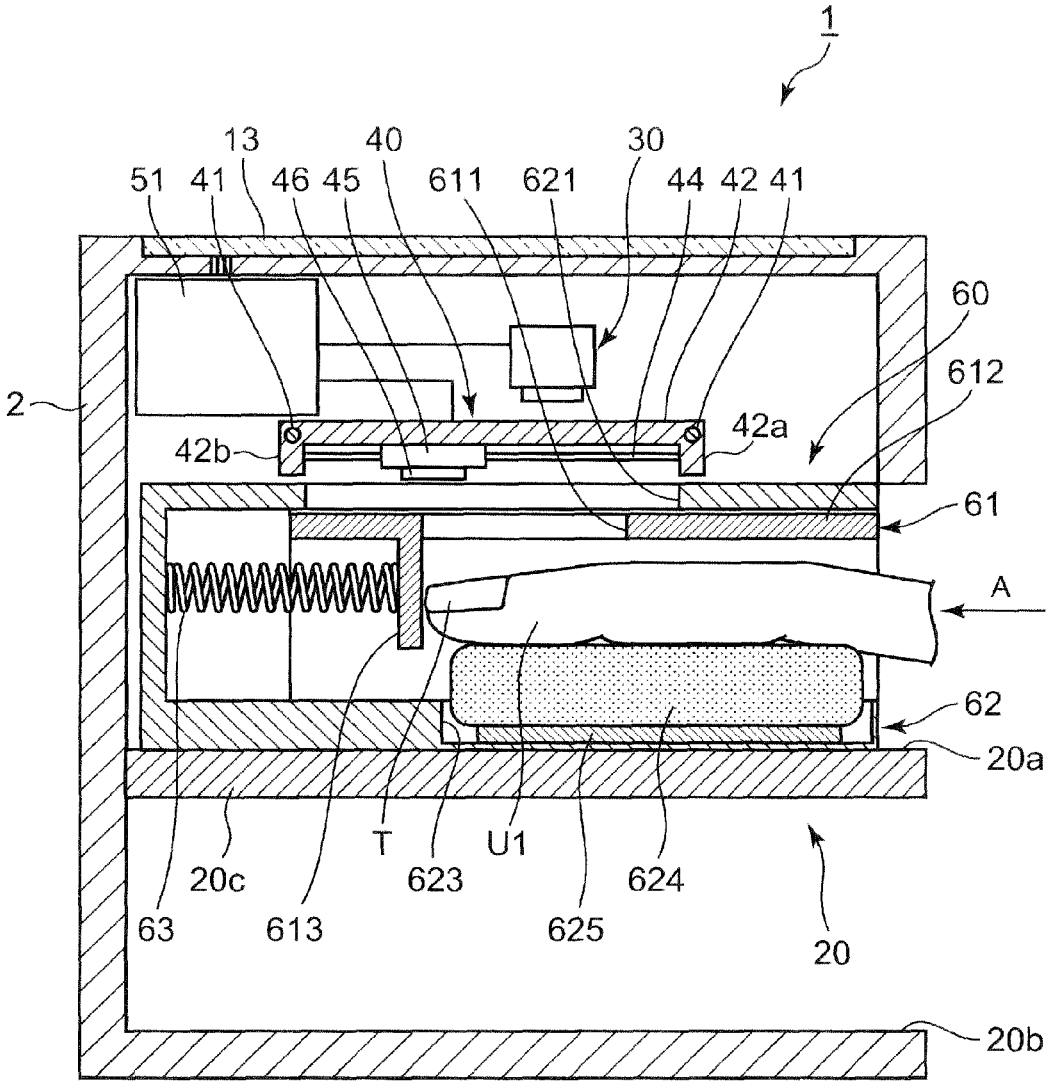
FIG. 2 is a sectional side view of the nail print apparatus of a first embodiment.

FIG. 2 is a sectional side view showing an internal configuration of the case body of the nail print apparatus.

As shown in FIG. 2, a control board 51 in which a printing finger fixation section 20 which constitutes the printing finger fixation device in the nail print apparatus 1, a photographing section 30 which constitutes the photographing device, a printing section 40 which constitutes the printing device and a control section 50 which constitutes the control device (see FIG. 8) and so forth is provided inside the case body 2.

The printing finger fixation section 20 is to fixate a finger (hereinafter, called "printing finger) U1 of a nail portion T to which printing is to be performed and is provided at a lower part of the case body 2. In this embodiment, the printing finger fixation section 20 is constituted of a printing finger fixation unit 60 (see FIG. 3, for example), a finger fixation unit housing section 20*a*, a non-printing finger insertion section 20*b* and a holding section 20*c*. Further, photographing and printing of the printing finger U1 are performed in a state where the printing finger U1 is inserted in the printing finger fixation unit 60 and the printing finger U1 is fixated at the printing finger fixation section 20.

The finger fixation unit housing section 20*a* is a housing section for housing the printing finger fixation unit 60 which fixates the printing fingers U1. The bottom of the finger fixation unit housing section 20*a* functions as a finger fixation unit mounting device for mounting the printing finger fixation unit 60.

The non-printing finger insertion section 20*b* is an insertion section for inserting a finger (not shown in the drawings, hereinafter, called "non-printing finger") other than the fingers of nail portions T to which printing is to be performed.

The holding section 20*c* is a portion that can be held by being sandwiched by the printing fingers U1 which are inserted in the printing finger fixation unit 60 housed in the finger fixation unit housing section 20*a* and the non-printing finger which is inserted in the non-printing finger insertion section 20*b*. In this embodiment, the holding section 20*c* is constituted of a partition wall which separates the finger fixation unit housing section 20*a* and the non-printing finger insertion section 20*b*.

Shape of the end portion on the finger inserting side of the holding section (partition wall) 20*c* is not specifically limited. For example, a bulged portion in which the sectional shape thereof in the finger inserting direction is formed in around shape or the like may be provided at the part where bases of the printing fingers U1 and non-printing finger contact when the printing fingers U1 and non-printing finger are deeply inserted in the printing finger fixation unit 60 housed in the finger fixation unit housing section 20*a* and the non-printing finger insertion section 20*b*. When a bulged portion is formed at the end portion on the finger inserting side of the holding section (partition wall) 20*c*, it is preferred because the holding section (partition wall) 20*c* can be held firmly with the printing fingers U1 and non-printing finger while the printing fingers U1 are inserted in the printing finger fixation unit 60. Here, shape of the bulged portion is not limited to the sectional round shape, and can be non-circular shape such as a sectional oval shape, a sectional polygon shape and so forth.

Here, the above mentioned printing finger insertion section 20*b* and the holding section 20*c* are not required. However, by having the above sections, the printing finger fixation unit 60 housed in the finger fixation unit housing section 20*a* and the printing fingers U1 which are inserted in the printing finger fixation unit 60 can be stable, and thus, such configuration is extremely effective for fixating the printing fingers U1.

Here, the printing finger fixation unit 60 housed in the finger fixation unit housing section 20*a* will be particularly described with reference to FIGS. 3 to 7.

Figure 3:
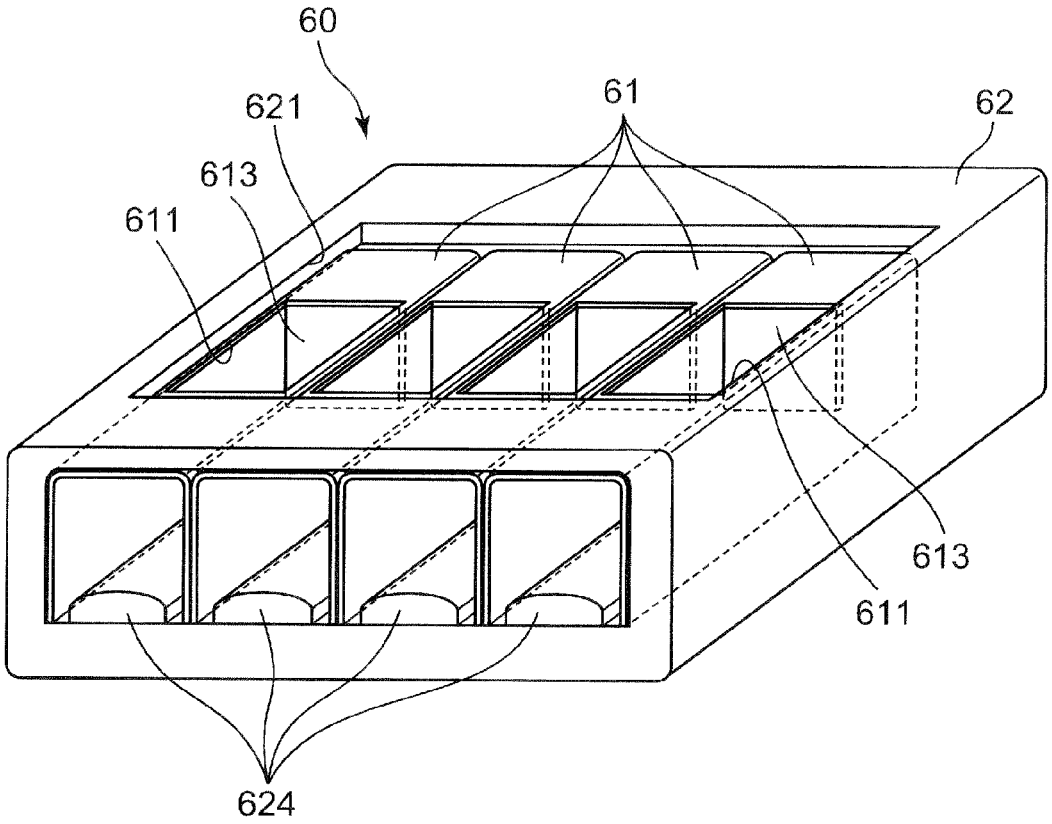
FIG. 3 is a schematic view showing a main configuration of a printing finger fixation unit shown in FIG. 2.
Figure 4:
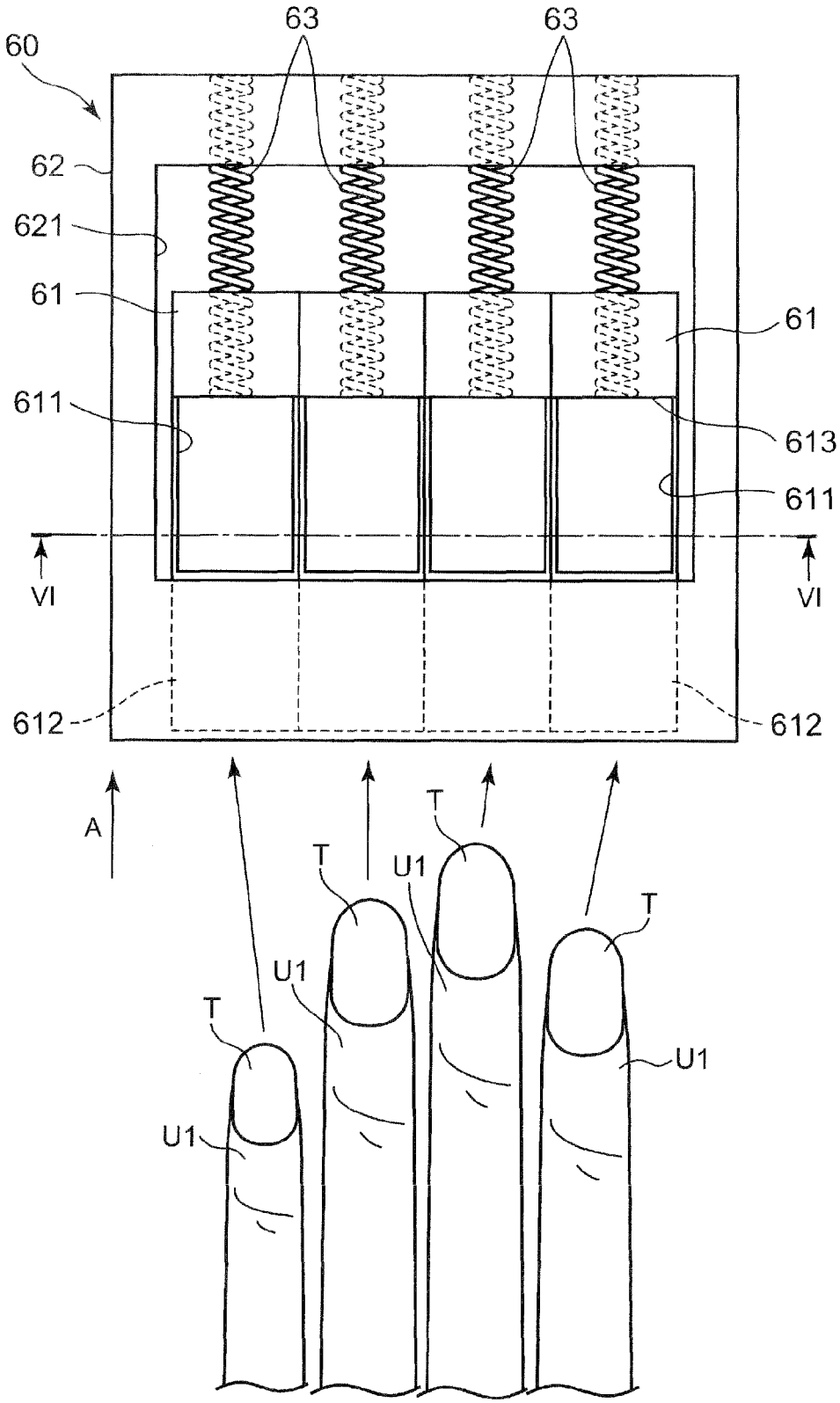
FIG. 4 is a plan view of the printing finger fixation unit shown in FIG. 3 when seen from above, wherein fingers which are an index finger to a little finger as printing fingers are being inserted into the printing finger fixation unit.
Figure 5:
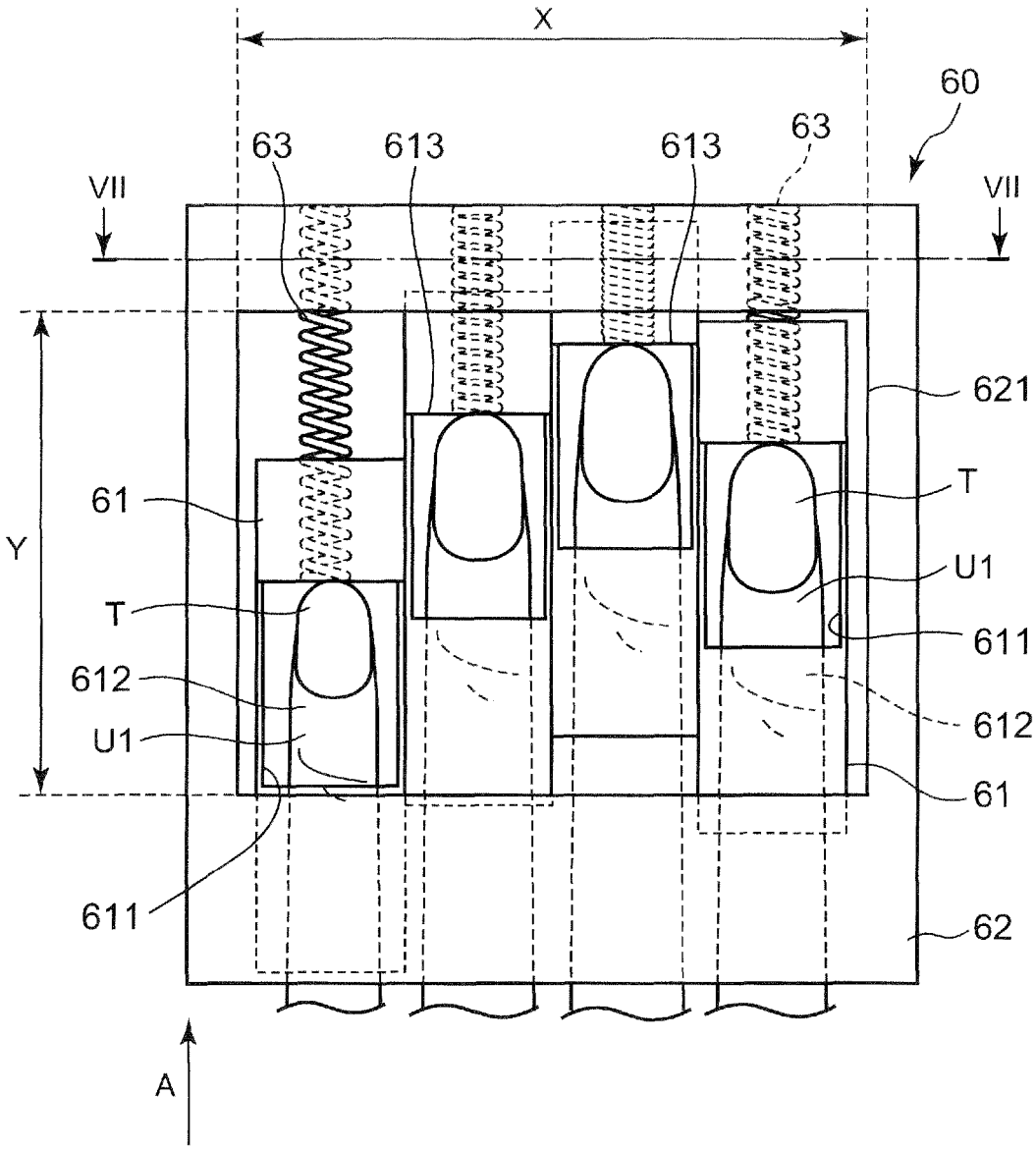
FIG. 5 is a plan view showing a state where an index finger to a little finger are inserted in the printing finger fixation unit shown in FIG. 4 as printing fingers.
Figure 6:
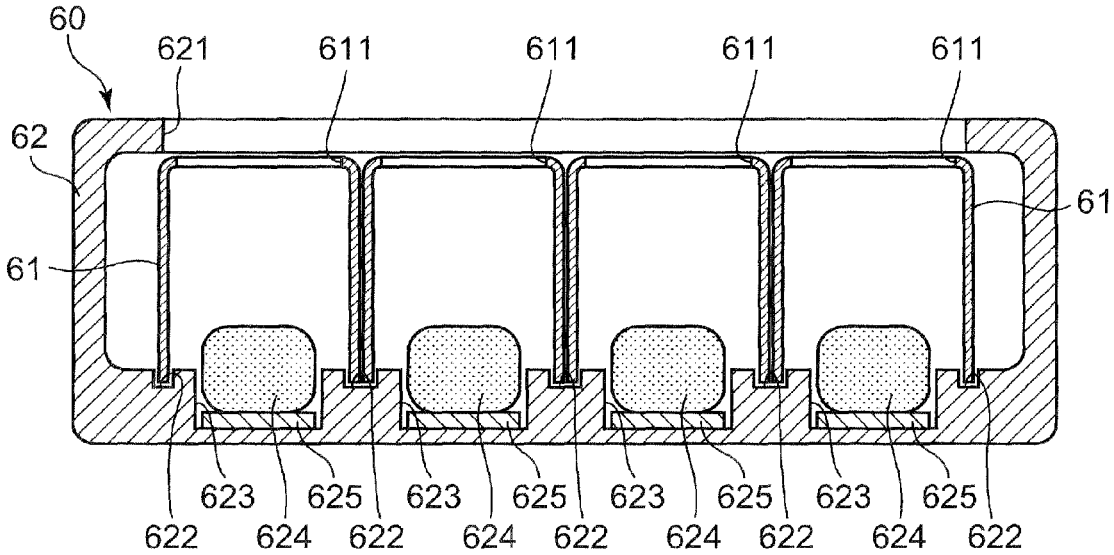
FIG. 6 is a sectional view of the printing finger fixation unit when cut along the line VI-VI of FIG. 4.
Figure 7:
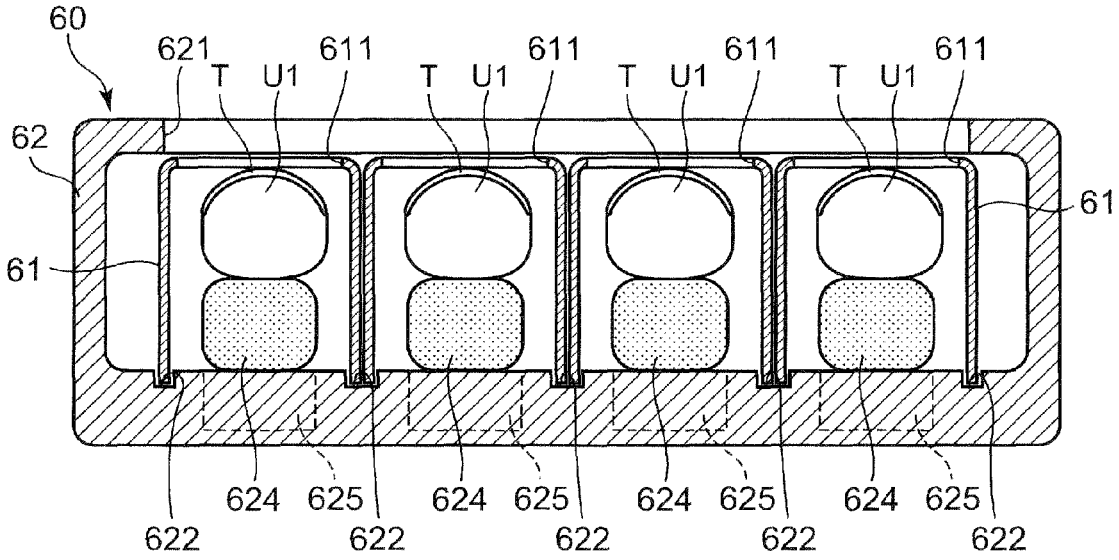
FIG. 7 is a sectional view of the printing finger fixation unit when cut along the line VII-VII of FIG. 5.

FIG. 3 is a schematic view of the printing finger fixation unit 60 of this embodiment, FIG. 4 is a plan view of the printing finger fixation unit 60 when seen from above (from above in FIG. 2) and FIG. 5 is a plan view showing a state where four fingers which are an index finger to a little finger of left hand are inserted in the printing finger fixation unit 60 of FIG. 4. Further, FIG. 6 is a sectional view of the printing finger fixation unit 60 cut along the line VI-VI in FIG. 4 and FIG. 7 is a sectional view of the printing finger fixation unit 60 cut along the line VII-VII in FIG. 5.

As shown in FIGS. 3 to 7, in this embodiment, the printing finger fixation unit 60 includes four finger insertion members 61 which are configured so that a finger can be inserted in each of them and a cover member 62 which houses the four finger insertion members 61. In this embodiment, a case where the printing finger fixation unit 60 includes four finger insertion members 61 will be described as an example. However, the number of the finger insertion member 61 to be included in the printing finger fixation unit 60 is not limited to four. For example, when the nail print apparatus 1 is a type where the printing fingers U1 are to be printed one finger at a time, merely one finger insertion member 61 needs to be provided. Further, it can be configured so that the finger insertion member 61 to be housed in the printing finger fixation unit 60 can be changed according to the type, number and so forth of the fingers to be printed so that the type and number of the finger insertion members 61 can be changed.

Each finger insertion member 61 is a member in a sectional U-shape in which one side thereof is open (see FIG. 6, for example), and each finger insertion member 61 is housed in the cover member 61 so that the opened side face down (downward in FIG. 2).

A nail portion exposure window 611 is formed in the surface (upper surface in FIG. 2) which faces the opened side of the finger insertion member 61, and a nail portion T of a printing finger U1 is to be exposed from the nail portion exposure window 611 when a printing finger U1 is inserted in the finger insertion member 61. It is preferred that the nail portion exposure window 611 is formed in a larger size so as to accommodate different sizes and shapes of fingers and nails of various users who are expected to use the nail print apparatus 1.

Here, it is sufficient that the nail portion T of a printing finger U1 can be exposed from the nail portion exposure window 611, and the position, size, shape and so forth of the nail portion exposure window 611 are not limited to the illustrated example.

A part of the surface (upper surface in FIG. 2) which faces the opened side of the finger insertion member 61 in the front side of finger inserting direction A (see FIG. 4, for example) than the nail portion exposure window 611 is a finger pressing section 612 which presses vicinity of the base of the nail portion T from above when the printing finger U1 is inserted.

An abutment member 613 where the tip portion of the printing finger U1 abuts when the printing finger U1 is inserted in the finger insertion member 61 is provided at the back in the finger inserting direction A (see FIG. 4, for example) than the nail portion exposure window 611 in each finger insertion member 61. In this embodiment, the abutment member 613 is a plate-like member which stands approximately upright downward (that is, toward opened side of the finger insertion member 61) from the back side edge of the nail portion exposure window 611 in the finger inserting direction A.

Here, it is sufficient that the abutment member 613 is provided at a position that allows the nail portion of the printing finger U1 be exposed from the nail portion exposure window 611 when the tip portion of the printing finger U1 inserted in each finger insertion member 61 abuts the abutment member 613, and shape, size, position and so forth of the abutment member 613 are not limited to the illustrated example.

The cover member 62 is a box-like member in which one side is opened. As shown in FIG. 3, four finger insertion members 61 are arranged in the opening in this embodiment. The printing finger fixation unit 60 is housed in the finger fixation unit housing section 20 aso that the opening of the cover member 62 be in front side in the finger inserting direction A.

A nail portion exposure opening 621 for exposing the nail portions T of the printing fingers U1 which are exposed from the nail portion exposure windows 611 of the finger insertion members 61 is provided in the upper surface (upper surface in FIGS. 2 and 6, for example) of the cover member 62.

The length X in width direction (horizontal direction in FIG. 6, for example) of the nail portion exposure opening 621 is longer than the length from the left side of the nail portion exposure window 611 of the finger insertion member 61 which positions at most left in the cover member 62 to the right side of the nail portion exposure window 611 of the finger insertion member 61 which positions at most right in the cover member 62, as shown in FIG. 7, so that all of the nail portion exposure windows 611 of the four finger insertion members 61 housed in the cover member 62 can be exposed. Further, the length Y in the finger inserting direction A (vertical direction in FIGS. 4 and 5) of the nail portion exposure opening 621 is longer than the length from the front side end of the nail portion exposure window 611 from which the nail portion T of the printing finger U1 (for example, a little finger) in which the nail portion T positions at the most front side in the finger inserting direction A is exposed to the back side end of the nail portion exposure window 611 from which the nail portion T of the printing finger U1 (for example, a middle finger) in which the nail portion T positions at the most back in the finger inserting direction A is exposed, as shown in FIG. 7.

As shown in FIG. 6, a pair of guide channels 622 for receiving lower ends of side walls of the finger insertion member 61 is formed along the finger inserting direction A at a position corresponding to each of four finger insertion members 61 on the bottom of the cover member 62 (lower side in FIGS. 2 and 6, for example). The guide channels 622 are guide sections which guide each finger insertion member 61 in the inserting direction A of the printing finger U1 when the printing finger U1 is inserted in the finger insertion member 61 and the finger insertion member 61 is pushed back by the printing finger U1.

Moreover, a concave section 623 is formed between the guide channels 622 forming a pair which receive the side walls of each finger insertion member 61, that is, at lower side of each finger insertion member 61 on the bottom of the cover member 62. In each concave section 623, a finger placement member 624 which holds the printing finger U1 inserted in the finger insertion member 61 from below and a lifting mechanism 625 which lifts up the finger placement member 624 from below are provided.

The finger placement member 624 is an elastic member such as a resin or the like, for example, and can stably hold the printing finger U1. Here, it is sufficient that the finger placement member 624 can stably hold the printing finger U1, and its material, shape and so forth of the finger placement member 624 are not specifically limited.

The lifting mechanism 625 lifts up the finger placement member 624 from below by oil pressure or air pressure, for example. The lifting mechanism 625 is controlled by the after-mentioned control section 50 so that the finger placement member 624 rises and falls between the position where the lower half of the finger placement member 624 is housed in the concave section 623 and the position where vicinity of the base of the nail portion T in the upper side of the printing finger U1 inserted in the finger insertion member 61 contacts the finger pressing section 612 of the upper surface of the finger insertion member 61. Here, it is sufficient that the lifting mechanism 625 can make the finger placement member 624 rise and fall, and the configuration thereof is not limited to the illustrated example. For example, configuration may be such that a plate or the like for supporting the finger placement member 624 from below is provided and the finger placement member 624 is lifted by a user manually lifting the plate or the like, for example. In such case, by a user manually releasing the lifted state of the plate or the like, the position of the finger placement member 624 is made to fall to the original position.

A position recovery spring 63 is arranged between the back surface in the cover member 63 in the finger inserting direction A and each finger insertion member 61. The position recovery spring 62 is a position recovery device for pressing and returning the finger insertion member 61 to the original initial position (the position of the finger insertion member 61 shown in FIG. 4) when the printing finger U1 is inserted in the finger insertion member 61, slid toward back in the finger inserting direction A and pulled out. Here, the position recovery device for returning the finger insertion member 61 to the original position is not limited to a spring, and other devices may be used.

In this embodiment, one end of the position recovery spring 63 is fixed to the surface which is opposite of the side where the printing finger U1 abuts in the abutment member 613, and the other end of the position recovery spring 63 contacts the back surface of the cover member 62 in the finger inserting direction A. Here, it is sufficient that the position recovery spring 63 intervenes between the cover member 62 and the finger insertion member 61, and position where the position recovery spring is fixed to is not limited to the illustrated example.

At the cover member 62 or at one end of each finger insertion member 61, a stopper (not shown in the drawing) for preventing the finger insertion member from jumping out from the opening of the cover member 62 and falling out when the finger insertion member is pushed back toward front from back side in the finger inserting direction A by the position recovery spring 63 is provided. Here, the other end of the position recovery spring 63 may be fixed to the back surface of the cover member 62 in the finger inserting direction A. Further, the configuration may be that the finger insertion member 61 of the printing finger fixation unit 62 is made not to jump out from the opening of the finger fixation unit housing section 20*a* by making the size of the opening of the finger fixation unit housing section 20*a* be smaller than the size of the sectional shape of the finger insertion members 61 of the printing finger fixation unit 60, for example.

In this embodiment, when a printing finger U1 is inserted in the finger insertion member 61 until the tip of the printing finger U1 abuts the abutment member 613, the nail portion T is to be exposed from the nail portion exposure window 611 which is provided more in front in the finger inserting direction A than the abutment member 613, and also, vicinity of the base portion of the nail portion T is to be covered with the finger pressing section 612 which is provided more in front in the finger inserting direction A than the nail portion exposure window 611.

Moreover, when the tip of the printing finger U1 abuts the abutment member 613, the finger insertion member 61 is pushed toward back side of the cover member 62 in the finger inserting direction A. In such way, each finger insertion member 61 slides toward back side in the finger inserting direction A according to the length of the printing finger U1 which is inserted in the finger insertion member 61 while pressing and shrinking the position recovery spring 63.

Then, in a sate where the printing fingers U1 are inserted deeply until the bases of the printing fingers U1 and the non-printing finger contact the end portion of the holding section 20*c*, nail portions T of all of the printing fingers U1, from the longest printing finger U1 to the shortest printing finger U1, are to be exposed from the nail portion exposure opening 621 of the cover member 62 through the nail portion exposure windows 611. Further, by the finger placement members 624 being lifted by the lifting mechanisms 625, vicinity of the base portions of the nail portions T are to be pressed by the finger pressing sections 612 so as to prevent the nail portions T from rising up.

As shown in FIG. 2, the photographing section 30 is provided at above the printing finger fixation unit 60, that is, at upper part of the case body 2.

The photographing section 30 includes a camera 31 in which a driver is embedded, having about two million pixels or more, and a lighting device 32 such as white LED or the like arranged so as to encircle the camera 31. The photographing section 30 is constituted of the camera 31 and the lighting device 32.

The photographing section 30 lights up the printing fingers U1 fixed in the printing finger fixation unit 60 by the lighting device 32, and photographs the printing fingers U1 by the camera 31 to obtain a finger nail image. In this embodiment, the photographing section 30 functions as a photographing device which obtains a finger nail image by photographing the printing fingers U1 which are inserted in the printing finger fixation unit 60 and fixed to the printing finger fixation section 20.

The photographing section 30 is connected to the after-mentioned control section 50, and is controlled by the control section 50.

Moreover, a printing section 40 is a printing device which performs printing to each of the nail portions T of the printing fingers U1 fixed in the printing finger fixation unit 60 of the printing finger fixation section 20. Further, the printing section 40 is provided above the printing finger fixation unit 60 and at the upper part of the case body 2.

That is, two guide rods 41 are parallelly bridged between the two side panels of the case body 2. The guide rods 41 are disposed so that a main carriage 42 can slide freely. Further, as shown in FIG. 2, two guide rods 44 are parallelly bridged between the front wall 42*a* and the back wall 42*b* of the main carriage 42. The guide rods 44 are disposed so that a secondary carriage 45 can slide freely. A printing head 46 is mounted at the center of the lower surface of the secondary carriage 45. Here, guide rods are not limited to the two guide rods 41 and 44, and only one guide rod can be used. However, it is preferred that two or more guides rods 41 and 44 are provided so as to stably support and smoothly move the main carriage 42, secondary carriage 45 and printing head 46.

In this embodiment, the printing head 46 is a ink-jet type printing head which performs printing by directly spraying micro droplets of ink to the nail portions T which are media subjected to printing. Note that recording method of the printing head 46 is not limited to the ink-jet method.

The main carriage 42 is joined to the first motor 43 via a power transmission device (not shown in the drawing), and moves in right-left direction along the guide rods 41 by the forward and reverse rotation of the first motor 43. Further, the secondary carriage 45 is joined to the second motor 47 via a power transmission device (not shown in the drawing), and moves in front-back direction along the guide rods 44 by forward and reverse rotation of the second motor 47.

In this embodiment, the area that can be printed by the printing head 46 is in a range corresponding to the nail portion exposure opening of the cover member 62 (that is, within a range of X in horizontal direction and Y in vertical direction shown in FIG. 5), and printing can be performed to the nail portions T which are exposed from the nail portion exposure opening 621 in this range.

Moreover, in the case body 2, an ink cartridge (not shown in the drawings) for supplying ink to the printing head 46 is provided. The ink cartridge is connected to the printing head 46 via an ink supplying tube (not shown in the drawing) to accordingly supply ink to the printing head 46. Here, the configuration may be such that ink cartridge is mounted in the printing head 46 itself.

The printing section 40 includes the guide rods 41, the main carriage 42, the first motor 43, the guide rods 44, the secondary carriage 45, the printing head 46, the second motor 47, the ink cartridge and so forth. The first motor 43, the printing head 46, the second motor 47 of the printing section 40 are connected to the after-mentioned control section 50 and are controlled by the control section 50.

The operation section 12 is an input device for a user to carry out various types of inputs.

For example, in the operation section 12, a power switch button for turning on the power of the nail print apparatus 1, a print start switch button for starting printing process, a stop switch button for stopping the operation and various types of operations buttons 121 for carrying out other various types of inputs are arranged.

Moreover, the display section 13 is a display device constituted of a liquid crystal panel (liquid crystal display) or the like, for example.

Here, a touch panel can be configured integrally on the surface of the display section 13. In such case, it is configured so that various types of inputs can be carried out by touching the surface of the display section 13 by touching operation of a stylus pen, a finger tip and so forth (not shown in the drawing).

For example, in the display section 13, a finger nail image in which the printing fingers U1 are photographed, areas of nail portions T in the finger nail image, a nail image pattern to be printed in the areas of nail portions T of the printing fingers U1, a thumbnail image for design confirmation and the like are to be displayed.

Moreover, in this embodiment, when a finger nail image of the printing fingers U1 which are inserted in the printing finger fixation unit 60 and fixed in the printing finger fixation section 20 is photographed by the photographing section 30, the photographed finger nail image and an image showing a state where the printing fingers U1 are inserted in the printing finger fixation unit 60 (for example, the state shown in FIG. 5) are to be displayed in the display section 13, and the display section 13 functions as a display device for displaying a finger nail image photographed by the photographing section 30. By confirming the image displayed in the display section 13, a user can visually confirm whether her/his printing fingers U1 are inserted in the correct positions.

Figure 8:
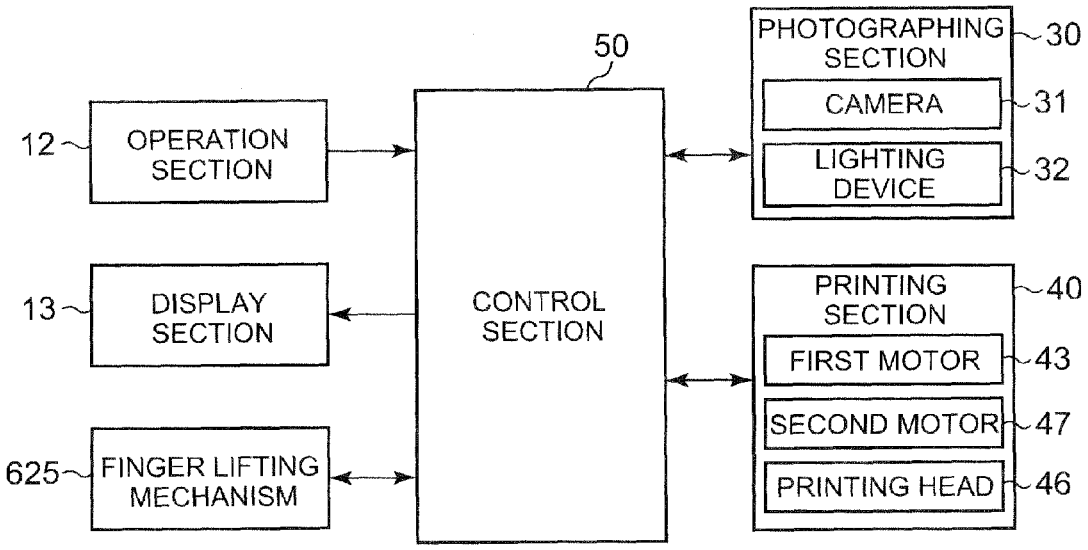
FIG. 8 is a main block view showing a control configuration of the nail print apparatus of the first embodiment.

Next, a control configuration of this embodiment will be described with reference to FIG. 8. FIG. 8 is a main block diagram showing the control configuration in this embodiment.

The control section 50 is a computer which is mounted on a control board 51 arranged at the upper part of the case body 2 and which includes a CPU (Central Processing Unit), a ROM (Read Only Memory), a RAM (Random Access Memory) and the like, which are not shown in the drawing, for example. Data such as nail image patterns to be printed and the like and various types of programs such as printing programs for performing printing process and the like are stored in the storage device such as ROM and the like, and the control section 50 controls each part of the nail print apparatus 1 by executing the programs.

In this embodiment, the finger lifting mechanisms 625 which lift up the finger placement members 624 on each of which the printing finger U1 is placed, the camera 31 and lighting device 32 which constitute the photographing section 30, the first motor 43 and the second motor 47 which constitute the printing section 40 and the printing head 46 are connected to the control section 50, and the control section 50 controls the operations of the above.

Moreover, instructions which are input by a user from the operation buttons 121 of the operation section 12 are transmitted to the control section 50, and the control section 50 carries out various types of controls based on the instruction signals.

Furthermore, the control section 50 controls the display section 13 to display various types of confirmation screens and the like on the display section 13.

Next, operations in this embodiment will be described with reference to FIGS. 4 to 7 and FIGS. 9A to 9C.

When performing printing to the nail portions T of printing fingers U1, a user first operates the operation button 121 and turns on the power of the nail print apparatus 1, and then, selects a nail image pattern (design) which the user desires to print on the nail portions T of the printing fingers U1. It is preferred that the selected nail image pattern is displayed in the display section 13 as a thumbnail image for design confirmation.

When a nail image pattern is selected, the user inserts the printing fingers U1 in the printing finger fixation unit 60 of the printing finger fixation section 20.

In particular, for example, when four fingers (index finger, middle finger, ring finger and little finger) other then thumb of left hand are the printing fingers U1, the user inserts each finger in each of the four finger insertion members 61 by inserting the little finger in the finger insertion member 61 of far left in the printing finger fixation unit 60, the ring finger in the finger insertion member 61 on the right for one slot, the middle finger in the finger insertion member 61 on the right for two slots and the index finger in the finger insertion member 61 of far right, succeeding from the far left finger insertion member 61. Further, the user inserts the thumb which is the non-printing finger in the non-printing finger insertion section 20*b*.

As shown in FIG. 4, when each of the four fingers, from index finger to little finger, is to be inserted in each of the finger insertion member 61 (see FIG. 9A), the finger insertion member 61 in which the longest finger of the four fingers (for example, middle finger) is inserted is pushed toward back in the finger inserting direction A while pushing and shrinking the position recovery spring 63 by the tip of the printing finger U1 abutting the abutment member 613, and the finger insertion member 61 in which the longest finger is inserted greatly slides along the finger inserting direction A (see FIG. 9B) as shown in FIG. 5 when the user inserts the printing fingers U1 deeply to the position where the bases of the printing fingers U1 and the non-printing finger contact the holding section 20*c*. On the other hand, the finger insertion member 61 in which the shortest finger of the four fingers (for example, little finger) is inserted is only slightly pushes toward back even when the tip of the printing finger abuts the abutment member 613 and does not slide. In such way, as shown in FIG. 5, each of the finger insertion member 61 stops at the position corresponding to the length of each of the inserted printing fingers U1.

Figure 9A:
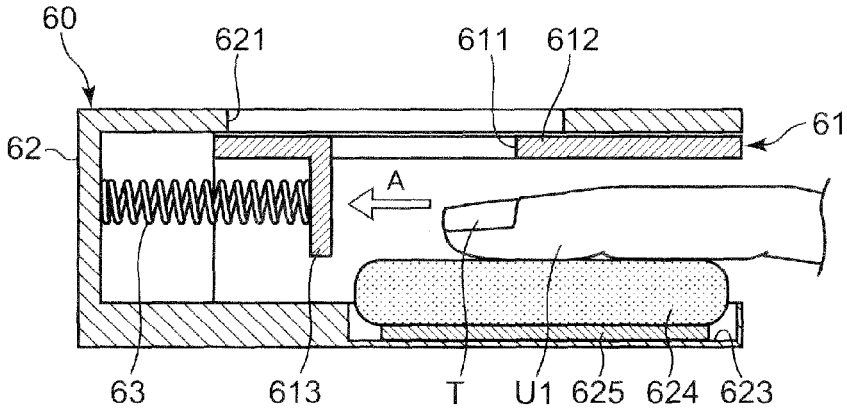
FIG. 9A is a sectional side view of the printing finger fixation unit of FIG. 3, wherein a printing finger is being inserted.
Figure 9B:
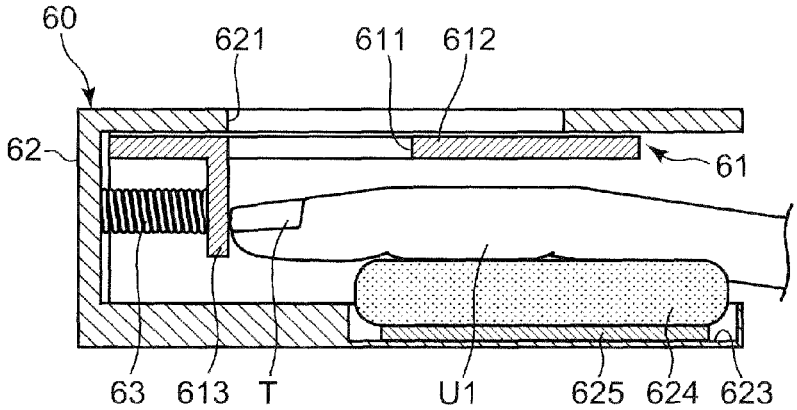
FIG. 9B is a sectional side view of the printing finger fixation unit of FIG. 3, wherein tip of the printing finger is pushing an abutment member.
Figure 9C:
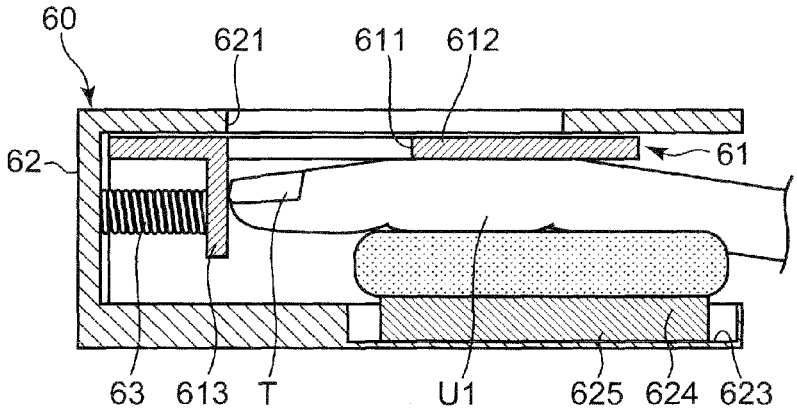
FIG. 9C is a sectional side view of the printing finger fixation unit of FIG. 3, wherein a finger placement member is lifted up by a lifting mechanism.

When the sliding of each finger insertion member 61 stops, the control section 50 controls the lifting mechanisms 625 and lifts up the printing fingers U1 which are respectively held on the finger placement members 624 from below, and makes the upper surfaces of the printing fingers U1 contact the back (lower side) of the upper surface of the finger insertion members 61 (see FIG. 7 and FIG. 9C). In such way, each of the printing fingers U1 is to be fixed in a state where the nail portion T is exposed from the nail portion exposure window 611 of the finger insertion member and being controlled so that vicinity of the base portion of the nail portion T being pressed by the finger pressing section 612 from above so that the nail portion T and the like do not rise.

Moreover, at this time, all of the nail portion exposure windows 611 of the finger insertion members 61 are arranged within the range corresponding to the nail portion exposure opening 621 of the cover member 62 as shown in FIG. 5 and the nail portions T of the printing fingers U1 inserted in the finger insertion members 61 are exposed from the nail portion exposure opening 621.

When the printing fingers U1 are fixed in the printing finger fixation section 20 as described above, the printing fingers U1 which are fixed in the printing finger fixation section 20 are photographed by the photographing section 30 and a finger nail image is obtained. Then, the obtained image is displayed in the display section 13, and the user confirms whether the printing fingers U1 are inserted at correct positions by looking at the image displayed in the display section 13.

When the printing fingers U1 are inserted at correct positions, the printing section 40 is operated and the selected nail image pattern (design) is to be printed to the nail portion T of each of the printing fingers U1 inserted in the finger insertion members 61.

When the printing process is completed, the control section 50 operates the finger lifting mechanisms 625 and returns the finger placement members 624 to the original position. Then, when the user pulls out the printing fingers U1 from the finger insertion members 61, the finger insertion members 61 are pushed back to the original positions by the position recovering springs 63.

As described above, according to this embodiment, the nail portion exposure windows 611 for exposing the nail portions T, the finger pressing sections 612 for pressing vicinity of the base portions of the nail portions T from above and the abutment members 613 where the tips of the printing fingers U1 abut when the printing fingers U1 are inserted are included, and the printing fingers U1 are fixated by respectively inserting the printing fingers U1 in the finger insertion members 61 which slide along the finger inserting direction A according to the length of each printing finger U1 when the printing fingers U1 are inserted. Therefore, the finger insertion member 61 slides to the position corresponding to the length of the printing finger U1 even when a printing finger U1 of any length is inserted, and the nail portion T can be exposed from the nail portion exposure window 611 and vicinity of the base portion of the nail portion T can be pressed by the finger pressing section 612 from above. Thus, the nail portion T of the printing finger U1 can be fixed at a position close to the printing head 46 as much as possible and also the printing finger U1 can be prevented from bent upward. In such way, by a simple method of inserting the printing fingers U1 in the finger insertion member 61, a fine printing can be carried out by applying ink accurately from a close distance, damage to the printing head 46 by the printing head 46 and the printing finger U1 contacting each other and attaching of ink and the like on the printing finger U1 can be inhibited surely. Furthermore, because vicinity of the base portion of the nail portion T is in a state covered with the finger pressing section 612, ink scattered from the printing head 46 can be prevented from attaching to vicinity if the base portion of the nail portion T.

Moreover, the guide channels 622 for guiding the finger insertion members 61 in the finger inserting direction A of the printing finger U1 when the printing fingers U1 are inserted in the finger insertion members 61 are provided in the cover member 62 which is provided in the printing finger fixation unit 60 of the printing finger fixation section 20. Therefore, when the printing fingers U1 abut the abutment members 613, the finger insertion members 61 can be made to smoothly slide to the back in the finger inserting direction A by pushing with the tips of the printing fingers U1.

Moreover, the finger placement member 624 formed with resin or the like is arranged at lower part of each finger insertion member 61. Therefore, the printing fingers U1 which are respectively inserted in the finger insertion members 61 can be held stably from below, and burden of the user who inserts the printing fingers U1 can be alleviated.

Moreover, because the lifting mechanisms 625 for lifting the finger placement members 624 from below are included, the user is not required to raise the finger placement members 624 by herself/himself to an appropriate height, and the printing fingers U1 can be fixed to appropriate positions (that is, appropriate position in the positional relation (distance and the like) between the nail portions T and the printing head 46) in a simple manner.

Moreover, in this embodiment, the finger nail image is obtained by photographing the printing fingers U1 which are fixed in the printing finger fixation section 20 by the photographing section 30 and the image is displayed in the display section 13. Therefore, the user can confirm whether her/his fingers are arranged in appropriate positions in a simple manner just by confirming the display section 13.

Second Embodiment

Next, the second embodiment of the nail print apparatus according to the present invention will be described with reference to FIGS. 10 and 11. Here, in this embodiment, only the configuration of the printing finger fixation unit is different from that in the first embodiment. Therefore, in the following description, only the aspects which are different from the first embodiment will be specifically described.

Figure 10:
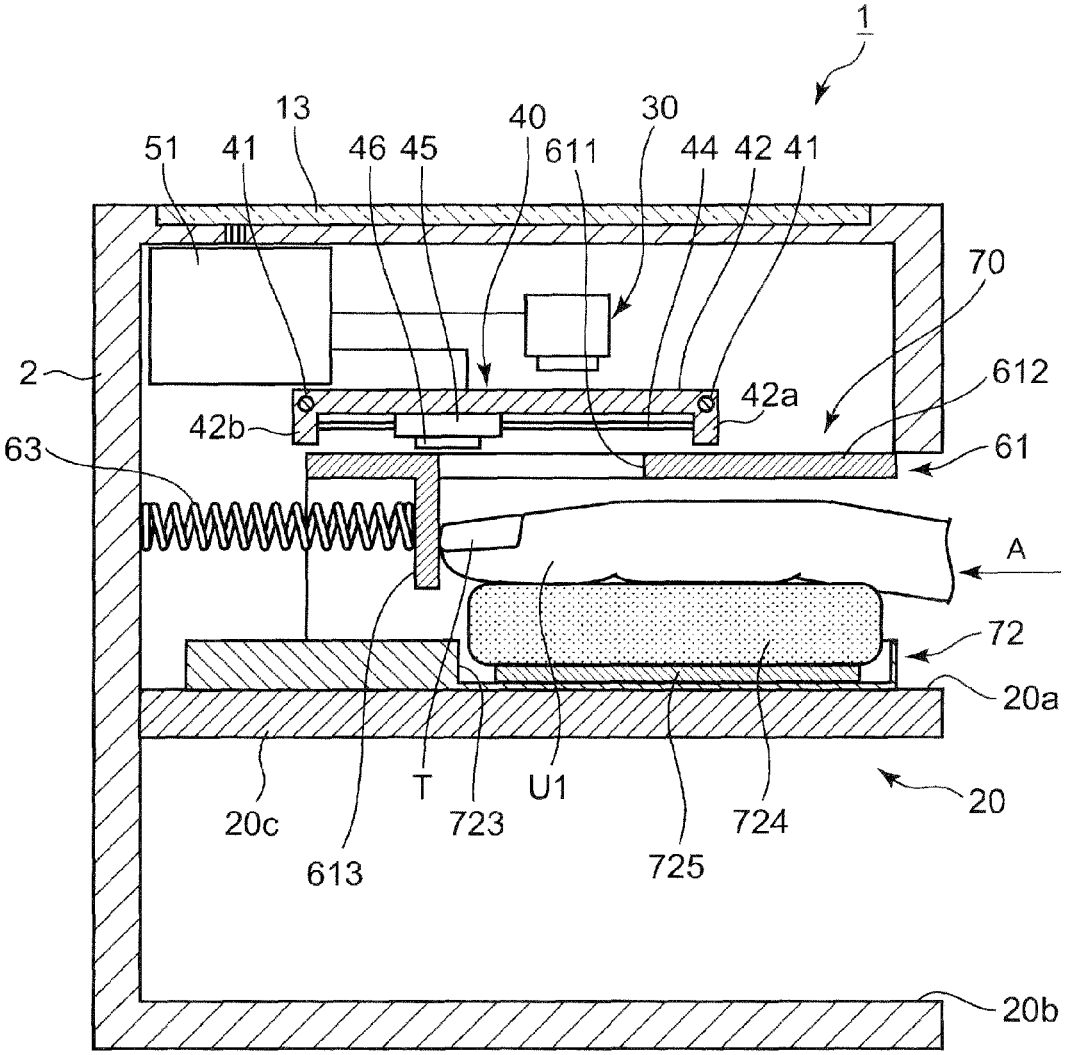
FIG. 10 is a sectional side view of a nail print apparatus according to a second embodiment.
Figure 11:
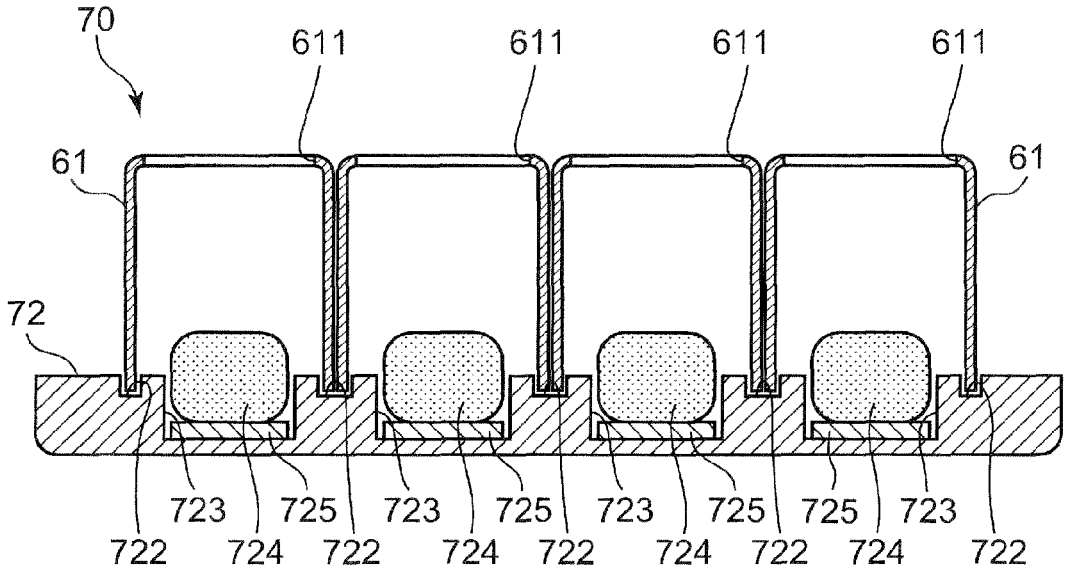
FIG. 11 is a sectional view of the printing finger fixation unit of the second embodiment when seen from a finger inserting direction.

FIG. 10 is a sectional side view of the nail print apparatus 1 of this embodiment, and FIG. 11 is a sectional view of the printing finger fixation unit shown in FIG. 10 when seen from the finger inserting direction A.

In this embodiment, the printing finger fixation unit 70 includes four finger insertion members 61 in each of which a finger can be inserted and a supporting member 72 which supports the four finger insertion members 61. The configuration of the finger insertion members 61 is similar to that in the first embodiment. Therefore, same reference numerals are used for the similar parts and the descriptions thereof are omitted.

As shown in FIG. 11, on the bottom of the supporting member 72 (lower side in FIGS. 10 and 11), a pair of guide channels 722 for receiving lower ends of side walls of the finger insertion members 61 is formed along the finger inserting direction A at a position corresponding to each of the four finger insertion members 61. The guide channels 722 are guide sections for guiding the finger insertion members 61 in the finger inserting direction A of the printing fingers U1 when the finger insertion members 61 are pushed toward back by the printing fingers U1 by the printing fingers U1 being respectively inserted in the finger insertion members 61.

Moreover, concave sections 723 are provided on the bottom of the supporting member 72 between the guide channels 722 which receive the side walls of the finger insertion members 61. In each concave section 723, a finger placement member 724 which holds the printing finger U1 inserted in the finger insertion member 61 from below and a lifting mechanism 725 which lifts up the finger placement member 724 from below is provided.

The configurations of the finger placement members 7124 and the lifting mechanisms 725 are similar to that in the first embodiment. Therefore, the descriptions will be omitted.

Moreover, in this embodiment, one end of the position recovery spring 63 is fixed to the surface which is opposite of the side where the printing finger U1 abuts in the abutment member 613, and the other end of the position recovery spring 63 contacts the back surface of the case body 2 in the finger inserting direction A. Here, similarly to the first embodiment, the positions where the position recovery springs are fixed to are not limited.

In this embodiment, nothing intervenes between the finger insertion members 61 and the photographing section 30 and between the finger insertion member 61 and the printing section 40. Therefore, the photographing section 30 and the printing section 40 are arranged at positions near the nail portion exposure windows 611 of the finger insertion members 61.

Here, other configurations are similar to that in the first embodiment. Therefore, the descriptions are omitted.

Next, operation in this embodiment will be described.

When printing is to be performed to the nail portions T of the printing fingers U1, a user selects a nail image pattern which the user desires to print of the nail portions and inserts printing fingers U1 in the printing finger fixation unit 70 of the printing finger fixation section 20.

In particular, for example, when four fingers (index finger, middle finger, ring finger and little finger) other then thumb are the printing fingers U1, the user inserts each finger in each of the four finger insertion members 61 by inserting the little finger in the finger insertion member 61 of far left in the printing finger fixation unit 60, the ring finger in the finger insertion member 61 on the right for one slot, the middle finger in the finger insertion member 61 on the right for two slots and the index finger in the finger insertion member 61 of far right, succeeding from the far left finger insertion member 61. Further, the user inserts the thumb which is the non-printing finger in the non-printing finger insertion section 20*b*.

In such way, when the four fingers (index finger, middle finger, ring finger and little finger) other then thumb are respectively inserted in the finger insertion members 61, each of the finger insertion members 61 accordingly slides toward back in the finger inserting direction A by the tip of the printing finger U1 abutting the abutment member 613 and stops at the position corresponding to the length of each of the inserted printing fingers U1.

When the sliding of each finger insertion member 61 stops, the control section controls each lifting mechanisms 725 to lift up the printing finger U1 held on the finger placement member 724 from below and makes the upper surface of each printing finger U1 contact the back (lower side) of the upper surface of the finger insertion member 61. In such way, the nail portions T of the printing fingers U1 are respectively exposed from the nail portion exposure windows 611 of the finger insertion members 61, and the printing fingers U1 are fixed in a state where vicinity of the base portions of the nail portions T are pressed by the finger pressing section 612 from above so as not to rise upward.

When the printing fingers U1 are fixated to the printing finger fixation section 20 as described above, the printing fingers U1 which are fixated to the printing finger fixation section 20 are photographed by the photographing section 30 and a finger nail image is obtained. Then, the obtained image is displayed in the display section 13, and the user can confirm whether the printing fingers U1 are inserted at correct positions by looking at the image displayed in the display section 13.

When the printing fingers U1 are inserted at correct positions, the printing section 40 is operated and the selected nail image pattern (design) is to be printed to the nail portion T of each of the printing fingers U1 inserted in the finger insertion members 61.

When the printing process is completed, the control section 50 operates each finger lifting mechanism 625 and returns the finger placement member 624 to the original position. Then, when the user pulls out the printing fingers U1 from the finger insertion member 61, the finger insertion members 61 are pushed back to the original positions by the position recovering springs 63.

As described above, according to this embodiment, the nail portion exposure windows 611 for exposing the nail portions T, the finger pressing sections 612 for pressing vicinity of the base portions of the nail portions T from above and the abutment members 613 where the tips of the printing fingers U1 abut when the printing fingers U1 are inserted are included, and the printing fingers U1 are fixated by respectively inserting the printing fingers U1 in the finger insertion members 61 which slide along the finger inserting direction A according to the length of each printing finger U1 when the printing fingers U1 are inserted. Therefore, the finger insertion member 61 slides to the position corresponding to the length of the printing finger U1 even when a printing finger U1 of any length is inserted, and the nail portion T can be exposed from the nail portion exposure window 611 and vicinity of the base portion of the nail portion T can be pressed by the finger pressing section 612 from above. Thus, the nail portion T of the printing finger U1 can be fixed at a position close to the printing head 46 as much as possible and also the printing finger U1 can be prevented from bent upward. In such way, by a simple method of inserting the printing fingers U1 in the finger insertion member 61, a fine printing can be carried out by applying ink accurately from a close distance, damage to the printing head 46 by the printing head 46 and the printing finger U1 contacting each other and attaching of ink and the like on the printing finger U1 can be inhibited surely. Furthermore, because vicinity of the base portion of the nail portion T is in a state covered with the finger pressing section 612, ink scattered from the printing head 46 can be prevented from attaching to vicinity if the base portion of the nail portion T.

Moreover, the supporting member 72 provided in the printing finger fixation unit 70 includes the guide channels 722 which guide the finger insertion members 61 in the finger inserting direction A of the printing fingers U1 when the printing fingers U1 are inserted in the finger insertion members 61. Therefore, when the printing fingers U1 abut the abutment members 613, the finger insertion member 61 can smoothly slide toward back in the finger inserting direction A by the tips of the printing fingers pushing the finger insertion members 61.

Moreover, the finger placement member 624 formed with resin or the like is arranged at lower part of each finger insertion member 61. Therefore, the printing fingers U1 which are respectively inserted in the finger insertion members 61 can be held stably from below, and burden of the user who inserts the printing fingers U1 can be alleviated.

Moreover, because the lifting mechanisms 625 for lifting the finger placement members 624 from below are included, the user is not required to raise the finger placement members 624 by herself/himself to an appropriate height, and the printing fingers U1 can be fixed to appropriate positions (that is, appropriate position in the positional relation (distance and the like) between the nail portions T and the printing head 46) in a simple manner.

Moreover, in this embodiment, the finger nail image is obtained by photographing the printing fingers U1 which are fixed in the printing finger fixation section 20 by the photographing section 30 and the image is displayed in the display section 13. Therefore, the user can confirm whether her/his fingers are arranged in appropriate positions in a simple manner just by confirming the display section 13.

Moreover, in this embodiment, a cover member for covering the upper side of the finger insertion members 61 is not included as in the first embodiment. Therefore, the photographing section 30 and the printing section 40 can be arranged at positions very close to the nail portions T exposed from the nail portion exposure windows 611 of the finger insertion members 61. Thus, clearer finger nail image can be photographed. Further, by making the printing head 46 and the nail portions T which is subjected to printing be close to each other, the distance between discharge to landing of ink can be short, and ink droplets can be applied accurately enabling even more fine printing, and occurrence of ink mist and scattering of ink can be inhibited.

Here, in this embodiment, the case where the printing finger fixation unit 70 includes the finger insertion members 61 and the supporting member 72 and where the guide channels 722, the concave sections 723, the finger placement members 724, the lifting mechanism 725 and the like are provided in the supporting member 72 is described as an example. However, configuration of the printing finger fixation unit 70 is not limited to the above, and can be a configuration in which the supporting member 72 is not included.

In such case, the guide channels for guiding the finger insertion members 61 and the concave sections may be formed in the partition wall which constitutes the holding section 20*c*, and the finger placement members and the lifting mechanisms and the like can be arranged in the concave sections, respectively.

In the case of such configuration, the number of components constituting the printing finger fixation unit can be reduced and the apparatus can be smaller, lighter and in lower-cost.

Third Embodiment

Next, the third embodiment of the nail print apparatus according to the present invention will be described with reference to FIGS. 12 to 14. Here, in this embodiment, only the configuration of the printing finger fixation unit is different from that in the first embodiment and the second embodiment. Therefore, in the following description, the aspects which are different from the first embodiment and the second embodiment will be specifically described.

Figure 12:
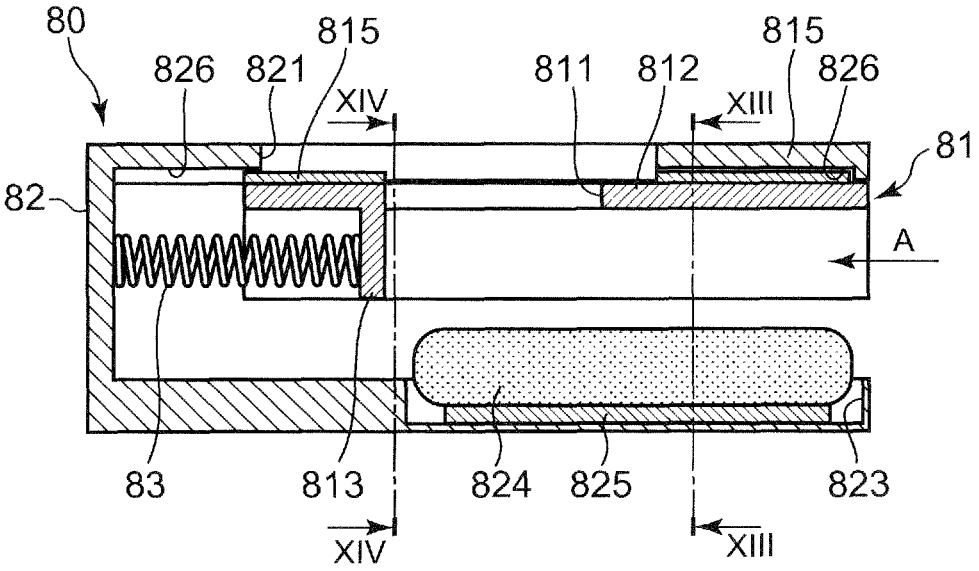
FIG. 12 is a sectional side view of the printing finger fixation unit according to a third embodiment.
Figure 13:
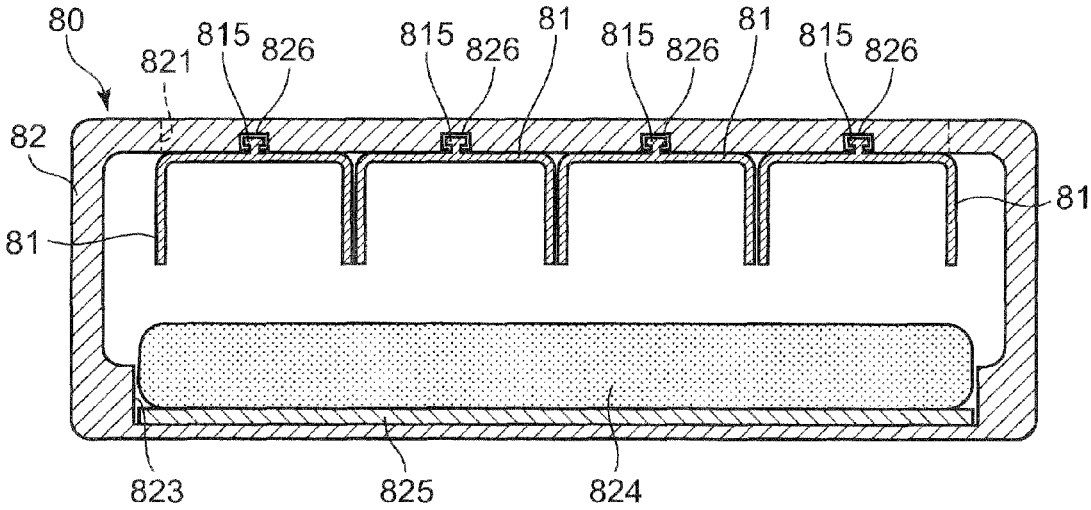
FIG. 13 is a sectional view of the printing finger fixation unit cut along the line XIII-XIII on FIG. 12.
Figure 14:
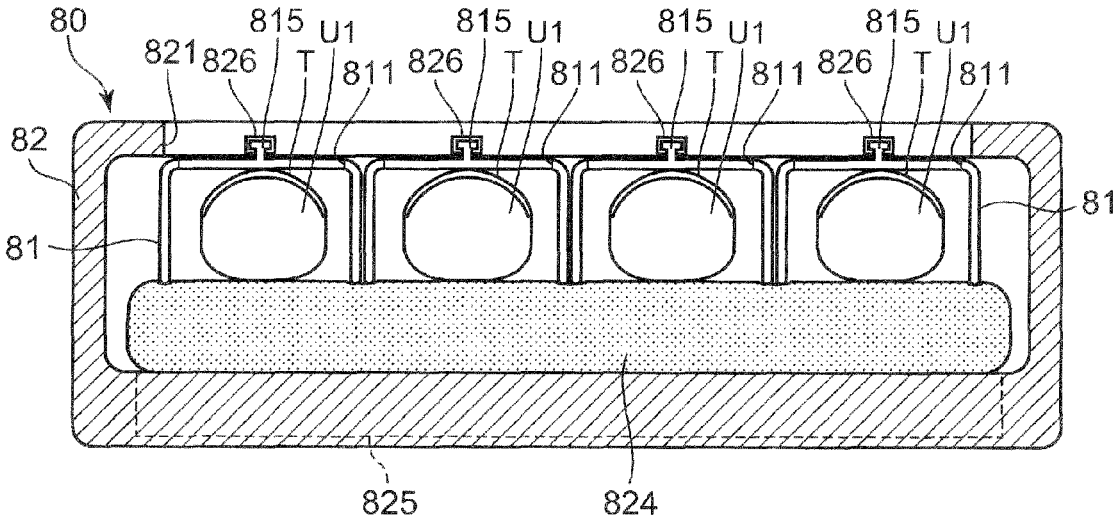
FIG. 14 is a sectional view of the printing finger fixation unit cut along the line XIV-XIV of FIG. 12.

FIG. 12 is a sectional side view of the printing finger fixation unit of this embodiment, FIG. 13 is a sectional view cut along the line XIII-XIII in FIG. 12 and FIG. 14 is a sectional view cut along the line XIV-XIV in FIG. 12.

In this embodiment, the printing finger fixation unit 80 includes four finger insertion members 81 which are configured so that a finger can be inserted in each of them and a cover member 82 which houses the four finger insertion members 81.

As shown in FIGS. 12 to 14, in this embodiment, the height of the side walls of the finger insertion members 81 is about half of the height of the cover member 82. Similarly to the first embodiment and the second embodiment, a nail portion exposure window 811, a finger pressing section 812 and an abutment member 813 are provided in each finger insertion member 81.

Moreover, a guide rail 815 formed in an approximately sectional T-shape, is provided along the finger inserting direction A of each finger insertion member 81 (upper side in FIGS. 12 and 14).

Here, other configurations are similar to that in the first embodiment and the second embodiment. Therefore the descriptions are omitted.

On inner surface in the upper side of the cover member 82 (upper side in FIGS. 12 to 14) at positions corresponding to the guide rails 815 of the finger insertion members 81, guide channels 826 for receiving the guide rails 815 are respectively provided.

Moreover, a concave section 823 is provided across approximately the entire width direction of the bottom of the cover member 82. In the concave section 823, a finger placement member 824 for holding the printing fingers U1 inserted in the finger insertion members 81 from below and a lifting mechanism 825 for lifting up the finger placement member 824 from below are provided.

As shown in FIGS. 13 and 14, the finger placement member 824 is provided by extending for approximately the entire width direction of the cover member 82, across all of the four finger insertion members 81. In such way, all of the four printing fingers U1 each of which are inserted in each of the four finger insertion members 81 can be held by one finger placement member 824. Here, configuration of the finger placement member 824 is not limited to the illustrated example, and a plurality of finger placement members formed by the one finger placement member being divided may be provided. Further, as for the lifting mechanism 825, one lifting mechanism 825 having the width approximately equal to the width of the finger placement member 824 can be provided, or a plurality of lifting mechanisms 825 in which the width is smaller than the width of the finger placement member 824 can be arranged.

Here, other configurations are similar to that in the first embodiment and the second embodiment. Therefore the descriptions are omitted.

Next, operations in this embodiment will be described.

When printing is to be performed to the nail portions T of the printing fingers U1, a user selects a nail image pattern which the user desires to print on the nail portions and inserts the printing fingers U1 in the printing finger fixation unit 80 of the printing finger fixation section 20.

In particular, for example, when four fingers (index finger, middle finger, ring finger and little finger) other then thumb are the printing fingers U1, the user inserts each finger in each of the four finger insertion members 81 by inserting the little finger in the finger insertion member 81 of far left in the printing finger fixation unit 80, the ring finger in the finger insertion member 81 on the right for one slot, the middle finger in the finger insertion member 81 on the right for two slots and the index finger in the finger insertion member 81 in the most right end, succeeding from the far left finger insertion member 61. Further, the user inserts the thumb which is the non-printing finger in the non-printing finger insertion section.

In such way, when the four fingers (index finger, middle finger, ring finger and little finger) other then thumb are respectively inserted in the finger insertion members 81, each of the finger insertion member 81 accordingly slides toward back in the finger inserting direction A by the tip of the printing finger U1 abutting the abutment member 813 and stops at the position corresponding to the length of each of the inserted printing fingers U1.

When the sliding of each finger insertion member 81 stops, the control section controls the lifting mechanisms 825 to lift up the printing fingers U1 held on the finger placement member 824 from below and makes the upper surfaces of the printing fingers U1 contact the back (lower side) of the upper surface of the finger insertion members 81. In such way, the nail portions T of the printing fingers U1 are respectively exposed from the nail portion exposure windows 611 of the finger insertion members 611, and the printing fingers U1 are fixed in a state where vicinity of the base portions of the nail portions T are pressed by the finger pressing sections 812 from above so as not to rise upward.

When the printing fingers U1 are fixated to the printing finger fixation section 20 as described above, the printing fingers U1 which are fixated to the printing finger fixation section are photographed by the photographing section 30 and a finger nail image is obtained. Then, the obtained image is displayed in the display section, and the user can confirm whether the printing fingers U1 are inserted at correct positions by looking at the image displayed in the display section.

When the printing fingers U1 are inserted at correct positions, the printing section is operated and the selected nail image pattern (design) is to be printed to the nail portion T of each of the printing fingers U1 inserted in the finger insertion members 81.

When the printing process is completed, the control section 50 operates the finger lifting mechanism 825 and returns the finger placement member 824 to the original position. Then, when the user pulls out the printing fingers U1 from the finger insertion member 81, the finger insertion members 81 are pushed back to the original positions by the position recovering springs 83.

As described above, according to this embodiment, the nail portion exposure windows 811 for exposing the nail portions T, the finger pressing sections 812 for pressing vicinity of the base portions of the nail portions T from above and the abutment members 813 where the tips of the printing fingers U1 abut when the printing fingers U1 are inserted are included, and the printing fingers U1 are fixated by respectively inserting the printing fingers U1 in the finger insertion members 81 which slide along the finger inserting direction A according to the length of each printing finger U1 when the printing fingers U1 are inserted. Therefore, the finger insertion member 81 slides to the position corresponding to the length of the printing finger U1 even when a printing finger U1 of any length is inserted, and the nail portion T can be exposed from the nail portion exposure window 811 and vicinity of the base portion of the nail portion T can be pressed by the finger pressing section 812 from above. Thus, the nail portion T of the printing finger U1 can be fixed at a position close to the printing head as much as possible and also the printing finger U1 can be prevented from bent upward. In such way, by a simple method of inserting the printing fingers U1 in the finger insertion member 81, a fine printing can be carried out by applying ink accurately from a close distance, damage to the printing head by the printing head and the printing finger U1 contacting each other and attaching of ink and the like on the printing finger U1 can be inhibited surely. Furthermore, because vicinity of the base portion of the nail portion T is in a state covered with the finger pressing section 812, ink scattered from the printing head can be prevented from attaching to vicinity if the base portion of the nail portion T.

Moreover, the guide rails 815 are respectively provided on the finger inserting members 81 and guide channels 826 for guiding the finger insertion members 81 in the finger inserting direction A by respectively receiving the guide rails 815 are provided in the upper surface of the cover member 82. Therefore, when the printing fingers U1 abut the abutment member 813, the finger insertion members 81 can smoothly slide toward back in the finger inserting direction A by pushing the finger insertion members 81 with the tips of the printing fingers U1.

Moreover, by providing the guide rails 815 and the guide channels 826 as guiding section at the upper side of the finger insertion members 81, each of the finger placement member 824 and the lifting mechanism 825 provided on the bottom of the cover member 82 can be one member corresponding to all of the four finger insertion members 81. Therefore, simplification of manufacturing process and reduction in cost can be realized by the number of components being reduced.

Here, in this embodiment, the case where the printing finger fixation unit 80 includes the finger insertion members 81 and the cover member 82 and where the guide channels 822, the concave 823, the finger placement member 824, the lifting mechanism 825 and the like are provided in the cover member 82 is described as an example. However, configuration of the printing finger fixation unit 80 is not limited to what is described above.

For example, the configuration may be that the cover member 82 does not have a bottom surface and only the guide channels 826 which respectively receive the guide rails 815 of the finger insertion members 81 are provided, and that the concave section is formed in the partition wall which constitutes the holding section 20*c* and the finger placement member, the lifting mechanism and the like are arranged in the concave section. In the case of such configuration, the thickness of the printing finger fixation unit 80 can be made to be thinner for the thickness of the bottom surface of the cover member 82, and the apparatus can be smaller and lighter.

Fourth Embodiment

Next, the fourth embodiment of the nail print apparatus according to the present invention will be described with reference to FIGS. 15 to 21. Here, in this embodiment, only the configuration of the printing finger fixation unit is different from that in the first embodiment. Therefore, in the following description, the aspects which are different from the first embodiment will be specifically described.

Figure 15:
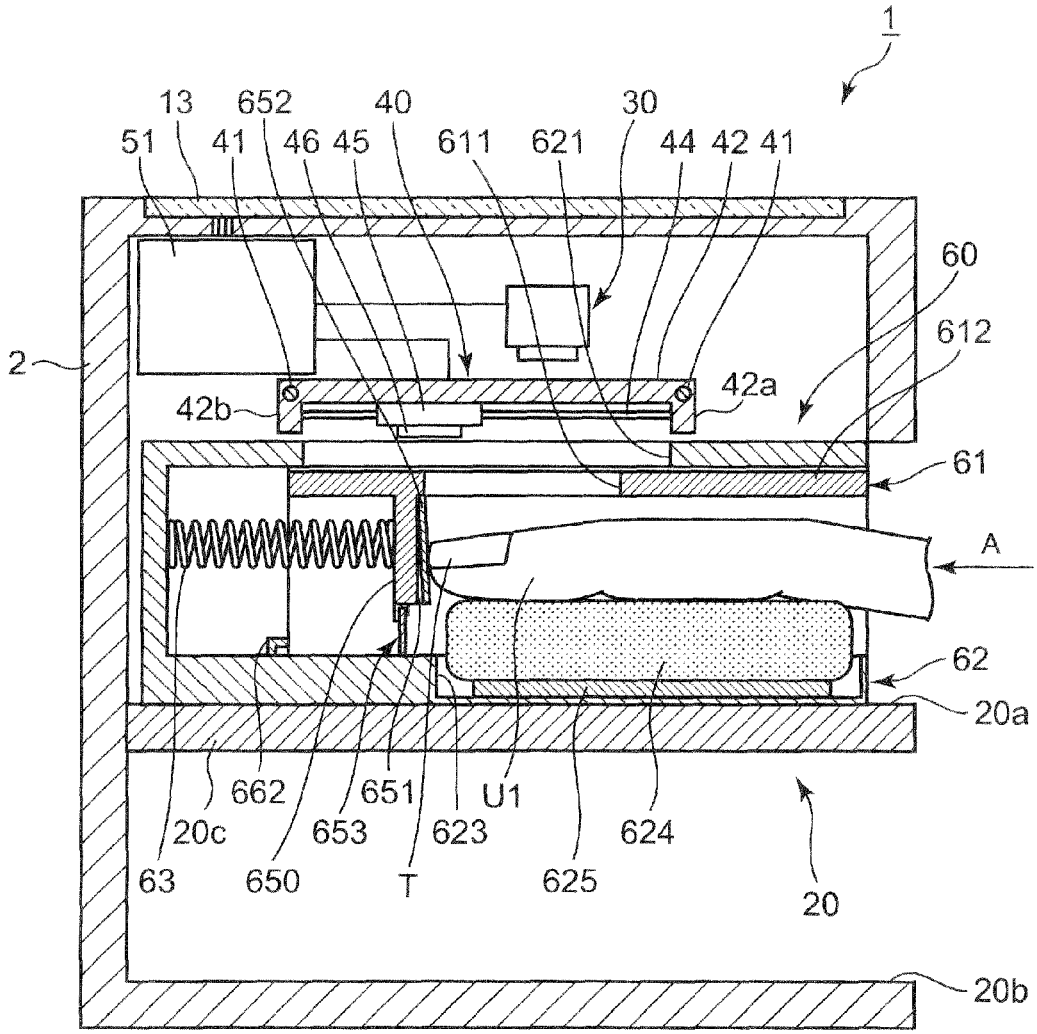
FIG. 15 is a sectional side view of a nail print apparatus according to a forth embodiment.

FIG. 15 is a sectional side view of the nail print apparatus of this embodiment.

As shown in FIG. 15, in this embodiment, the printing finger fixation unit 60 which fixates the printing fingers U1 is housed in the finger fixation unit housing section 20*a* of the nail print apparatus 1 similarly to the first embodiment.

In this embodiment, the printing finger fixation unit 60 includes finger insertion members 61 in each of which a printing finger U1 can be inserted and a cover member 62 which houses the finger insertion members 61.

Here, in this embodiment, the case where a plurality of finger insertion member 61 (four finger insertion members 61 in the illustrated example) corresponding to the plurality of printing fingers will be described as an example similarly to the first embodiment. However, the number of the finger insertion members 61 included in the printing finger fixation unit 60 is not limited to four. For example, when the nail print apparatus 1 is a type where the printing fingers U1 are to be printed one finger at a time, merely one finger insertion member 61 needs to be provided. Further, it can be configured so that the finger insertion members 61 to be housed in the printing finger fixation unit 60 can be changed according to the type, number and so forth of the fingers to be printed so that the type and number of the finger insertion members 61 can be changed.

An abutment member 650 where the tip portion of the printing finger U1 abuts when the printing finger U1 is inserted in the finger insertion member 61 is provided in the back in the finger inserting direction A (see FIG. 15, for example) than the nail portion exposure window 611 in each finger insertion member 61. In this embodiment, similarly to the first embodiment, each abutment member 650 is a plate-like member which stands approximately upright downward (that is, toward the opened side of the finger insertion member 61) from the back side edge of the nail portion exposure window 611 in the finger inserting direction A.

In this embodiment, a concave 651 is formed on the side where the tip of the printing finger U1 abuts in each abutment member 650. A plate switch 652 is provided in the concave 651 of each abutment member 650 so that one end thereof is fixed to the concave 651 and the free end thereof rises from the concave 651. Each plate switch 652 is a plate-like member having a spring-like nature, and the plate switch 652 be in ON state and outputs ON signal when the free end side which rises from the concave 651 is pressed into the concave 651 by being pushed with a relatively strong pressure, and the plate switch 652 be in OFF state and outputs OFF signal when the free end side is removed from the concave 651. The signals output from the plate switch 652 are transmitted to the after-mentioned control section 50.

In this embodiment, when the printing fingers U1 are respectively inserted in the finger insertion members 61 and the tips of the printing fingers U1 push in the free ends of the plate switches 652, the raised portion of each free end contacts inner side of the concave 651, and the plate switch 652 be in ON state and output ON signal. Further, when the tip portions of the printing fingers U1 are removed from the plate switches 652 by the printing fingers U1 being pulled out from the finger insertion members 61 and the free end side of each plate switch 652 rises from the concave 651, the plate switch 652 be in the OFF state and outputs the OFF signal.

In such way, each plate switch 652 function as a disjunction detection device which detects disjunction of the printing finger U1 with respect to the abutment member 650.

Here, when a plurality of finger insertion members 61 are provided, the plate switch 652 as a disjunction detection device is to be provided to the abutment member 650 of each finger insertion member 61.

In a state where the free end of the plate switch 652 is pressed into the concave 651, the plate switch 652 and the surface of the abutment member 650 on the side where the tip of the printing finger U1 abuts are flush with each other.

Here, positions, shape, size and so forth of the plate switches 652 are not limited to the illustrated example, and it is sufficient that the plate switches 652 are arranged so as to detect disjunction of the printing fingers U1 inserted in the finger insertion members 61 with respect to the abutment members 650.

Moreover, at the lower end of the abutment member 650 of each finger insertion member 61, a stopper mechanism 653 as a reverse movement restriction member which restricts the finger insertion member 61 from moving in the reverse direction when the finger insertion member 61 slides along the finger inserting direction A is provided.

Figure 16A:
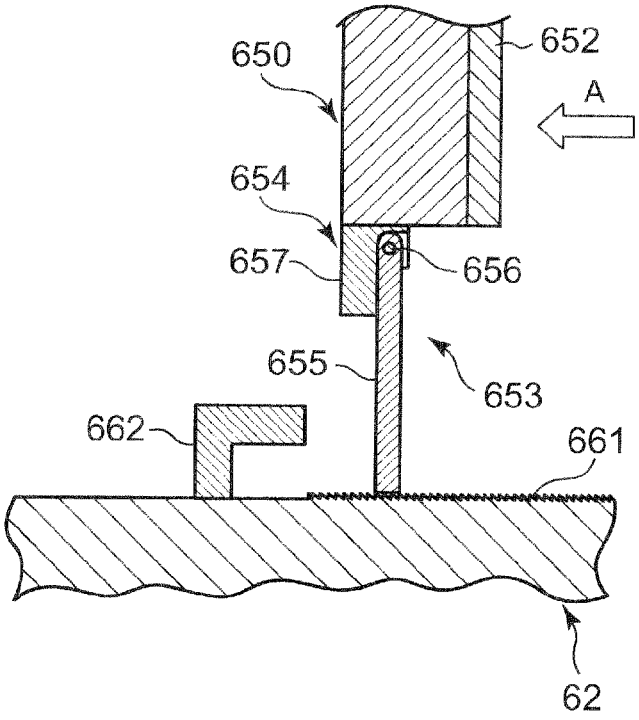
FIG. 16A is a sectional view of a stopper mechanism which is provided in the printing finger fixation unit shown in FIG. 15, wherein a movement is restricted by the stopper mechanism.
Figure 16B:
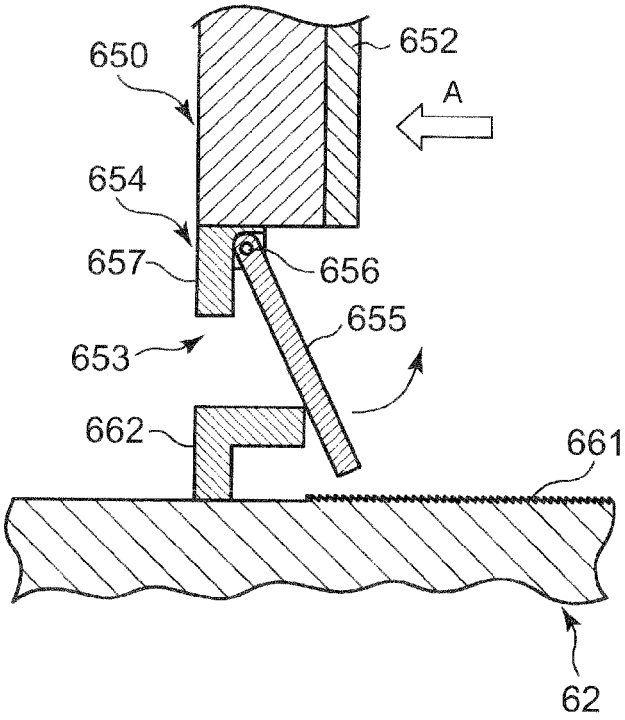
FIG. 16B is a sectional view of the stopper mechanism which is provided in the printing finger fixation unit shown in FIG. 15, wherein restriction of movement by the stopper mechanism is released by a restriction release member.
Figure 17A:
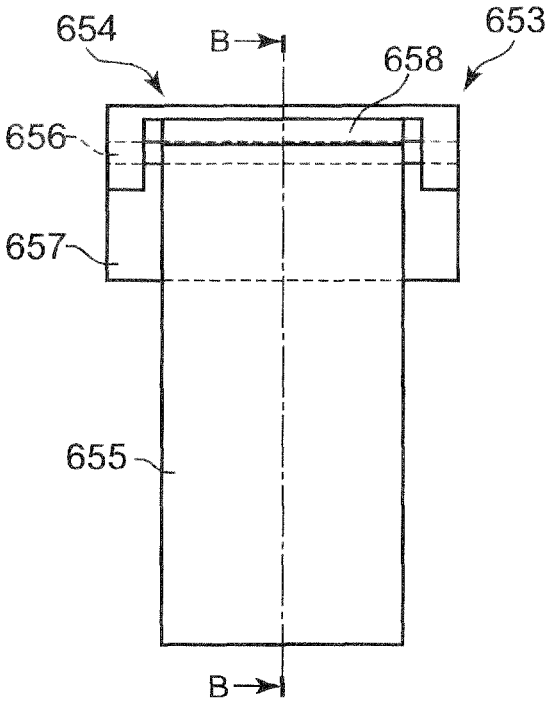
FIG. 17A is a front view of the stopper mechanism shown in FIG. 15 when seen from a finger inserting direction.
Figure 17B:
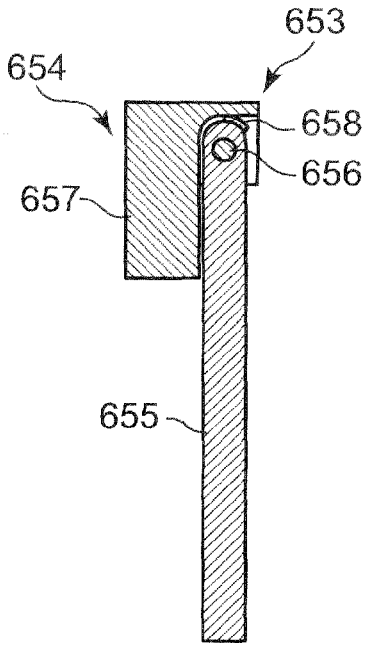
FIG. 17B is a sectional view cut along the line B-B of FIG. 17A.
Figure 17C:
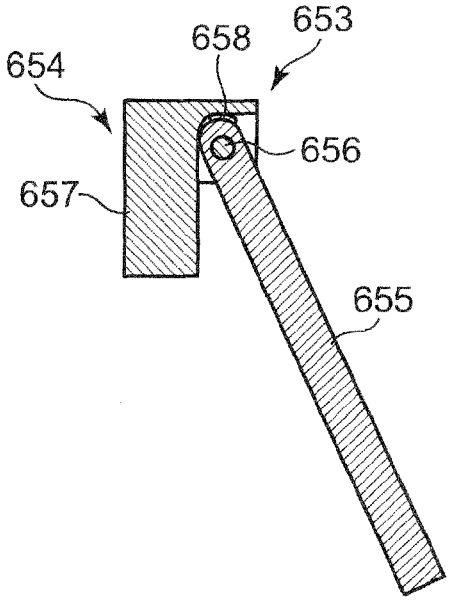
FIG. 17C is an enlarged view of a stopper member of FIG. 17B.

FIGS. 16A and 16B are sectional side views showing the abutment member 650 and the stopper mechanism 653 of this embodiment, FIG. 17A is a front view when the stopper mechanism 653 is seen from the finger inserting direction A (see FIG. 15), the stopper mechanism 653 being enlarged, FIG. 17B is a sectional side view cut along the line B-B in FIG. 17A, and FIG. 17C is a sectional side view showing a state where the stopper member 655 of FIG. 17B is turned.

As shown in FIGS. 16A and 16B and FIGS. 17A to 17C, the stopper mechanism 653 includes a stopper supporting member 654 which is fixed at the lower end of the abutment member 650 and a stopper member 655 which is shaft-supported by the rotation axis 656 to the stopper supporting member 654.

At the back side of the stopper supporting member 654 in the finger inserting direction A (left side in FIG. 15), a reverse rotation restriction member 657 which restricts the stopper member 655 from turning in a direction opposite of the direction shown by an arrow in FIG. 16B is provided.

The stopper member 655 can turn in the direction shown by the arrow in FIG. 16B by setting the rotation axis 656 as the supporting point, and the stopper member 655 maintains its turned state when turned for a predetermined amount or more. That is, at least a part of the upper end of the stopper member 655 is a nonskid processed section 658 where concaves and convexes are formed, for example, and the turned state of the stopper 655 is maintained by a free rotation of the stopper member 655 being restricted by the friction force when the nonskid processed section 658 contacts the inner surface of the stopper supporting member 654. Here, the configuration which allows the stopper member 655 to maintain its turned state is not limited to the illustrated example. For example, various alternative configurations such as convexes and concaves which engage with each other are respectively provided at the upper end of the stopper member 655 and the inner surface of the stopper supporting member 655 and free rotation of the stopper member 655 is to be restricted by the convexes and the concaves engaging with each other, and the like may be applied. Further, by performing nonskid process or the like to the rotation axis 656, the turned state of the stopper member 655 may be maintained when the stopper member 655 is once pushed up in a great extent.

The stopper member 655 is a plate like member which extends in a width direction (that is, a finger width direction of the printing finger U1 inserted in the finger insertion member 61) of the abutment member 650 of each finger insertion member 61, for example. Further, the lower end of the stopper member 655 contacts the bottom of the cover member 62 which houses the finger insertion members 61. In this embodiment, as shown in FIGS. 16A and 16B, a concavo-convex section 661 is provided on the bottom of the cover member 62, and the stopper member 655 restricts the finger insertion member 61 from moving by the friction force between the lower end of the stopper member 655 and the concavo-convex section 661 on the cover member 62 side.

Here, it is sufficient that the stopper member 655 can restrict moving of the finger insertion member 61, and its shape and the like are not specifically limited. For example, the stopper member 655 may be a rod-like member and not a plate-like member.

In this embodiment, as described above, the stopper member 655 is restricted so as not to turn in a direction opposite to the direction shown by an arrow in FIG. 16B by the reverse rotation restriction section 657. On the other hand, the stopper member 655 can rotate freely for a predetermined amount in the direction shown by the arrow in FIG. 16B.

Therefore, when a printing fingers U1 is inserted in each finger insertion member 61 and the abutment member 650 is pushed in the finger inserting direction A by the tip of the printing finger U1, the finger insertion member 61 can slide smoothly without causing a great friction force between the lower end of the stopper member 655 and the concavo-convex section 661 on the cover member 62 side because the stopper member 655 goes over the concavo-convex section 661 while slightly turning in the direction of the arrow in FIG. 16B. On the other hand, the abutment member 650 is pressured toward front side from back side of the finger inserting direction A by the position recovery spring 63. Therefore, when the printing finger U1 moves in a direction separating from the plate switch 652 of the abutment member 650, the stopper member 655 in pressed in the opposite direction of the finger inserting direction A (arrow A in FIGS. 16 and 17). In such case, the stopper member 655 does not rotate in the direction opposite of the direction of the arrow in FIG. 16B. Therefore, a great friction force occurs be between the stopper member 655 and the concavo-convex section 661, and in such way, the finger insertion member 61 is restricted from moving in the opposite direction of the finger inserting direction A and stops at the position without following the movement of the printing finger U1, or, the finger insertion member 61 is slowly pushed back by the position recovery spring 63.

Moreover, as shown in FIGS. 16A and 16B, a restriction release member 662 which releases the stopper member 655 is provided on the bottom of the cover member 62 at the back side in the finger inserting direction A than the position where the concavo-convex section 661 is provided. The restriction release member 622 is a sectional L-shaped member, and the restriction release member 622 pushes up the lower end portion of the stopper member 655 in the arrow direction shown in FIG. 16B and makes the stopper member 655 turn in the arrow direction for a predetermined amount or more. In such way, as described above, the nonskid processed section 658 contacts the inner surface of the stopper supporting member 654 and by the friction force thereof, the stopper member 655 is restricted from turning freely and the turned state of the stopper member 655 is maintained. As a result, there will be no friction force between the stopper member 655 and the concavo-convex section 661, and therefore, the finger insertion member 61 smoothly moves in the opposite direction of the finger inserting direction A by the pressure of the position recovery spring 63 and returns to the initial position which is the position before the printing finger U1 is inserted.

Here, shape and arrangement position and so forth of the restriction release member 662 are not limited to the illustrated example.

In this embodiment, when the abutment member 650 is pushed in further to the back side in the finger inserting direction A by the printing finger U1 again after the insertion of the finger insertion member 61 is stopped due to the printing finger U1 being removed from the plate switch 652 of the abutment member 650, the lower end portion of the stopper member 655 abuts the restriction release member 662 and is pushed up in the direction shown by the arrow in FIG. 16B and movement of the finger insertion member 61 restricted by the stopper member 655 is to be released.

Figure 18:
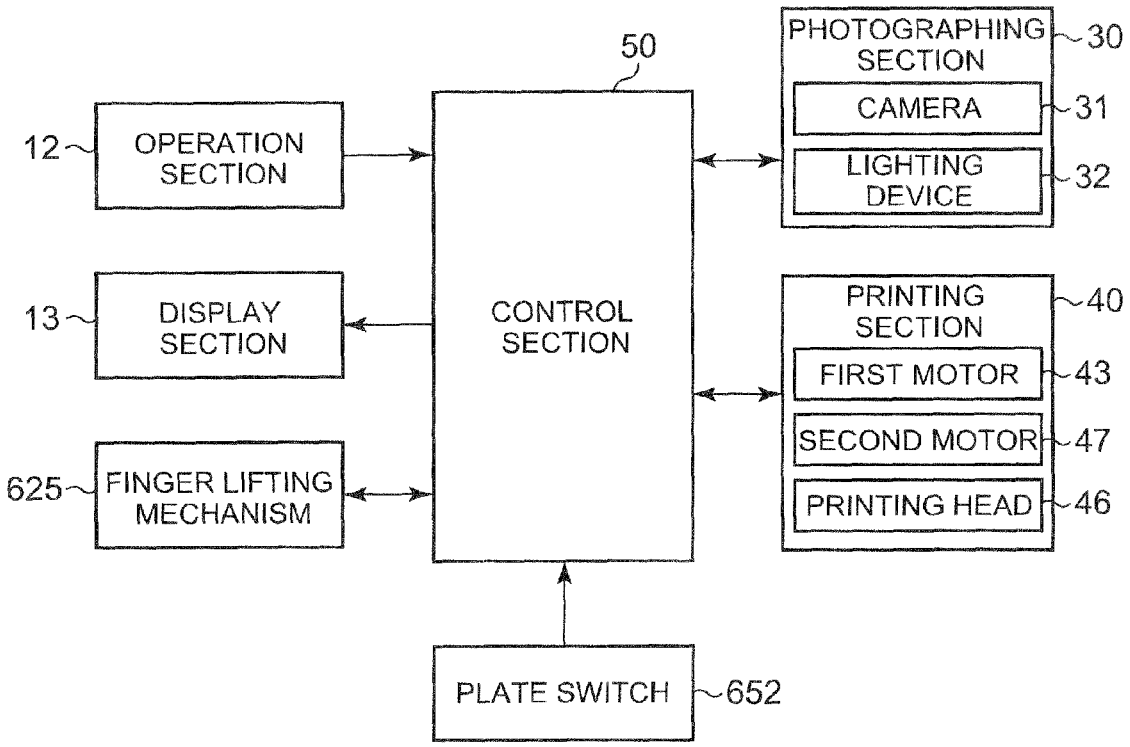
FIG. 18 is a main block diagram showing a control configuration of the nail print apparatus of the forth embodiment.

FIG. 18 is a main block diagram showing the control configuration in this embodiment.

In this embodiment, ON signal or OFF signal is transmitted to the control section 50 from each plate switch 652 which is the disjunction detection device.

That is, as described above, when the plate switch 652 is pushed by the tip of the printing finger U1 inserted in each finger insertion member 61 and abuts the abutment member 650 (the concave 651 of the abutment member 650 in this embodiment), the plate switch 652 be in ON state and output a detection signal (that is, ON signal) indicating that the printing finger U1 is contacting the abutment member 650 to the control section 50. Further, when the plate switch 652 is removed from the abutment member 650 (the concave 651 of the abutment member 650 in this embodiment) after detecting that the printing finger U1 is contacting the abutment member 650, the plate switch 652 be in OFF state and outputs a detection signal (that is, OFF signal) indicating that the printing finger U1 is removed from the abutment member 650 to the control section 50.

When it is detected that the printing finger U1 is contacting the abutment member 650 by the plate switch 652, that is, when ON signal is output from the plate switch 652, the control section 50 controls the printing section 40 which is a printing device so as to start printing operation to the nail portion T when detecting the contact (when receiving the ON signal) or after a predetermined time has elapsed after detecting of the contact. In particular, the control section 50 drives the printing head 43 based on printing data and discharges ink onto the nail portion T to perform printing to the nail portion T while appropriately moving the printing head 46 by driving the first motor 43 and the second motor 47.

Here, at which timing after detecting the contact of the printing finger U1 and the abutment member 650 (at the time of receiving ON signal) the printing is to be started can be set by default, such as ten seconds after detection, for example, or can be set freely by a user.

Moreover, when removing of the printing finger U1 from the abutment member 650 is detected by the plate switch 652 after starting of printing operation is started, that is, when OFF signal is output from the plate switch 652, the control section 50 controls the printing section 40 to stop the printing operation to the nail portion T. In particular, the control section 50 stops the printing head 46 by stopping the first motor 43 and the second motor 47, and stops the driving of the printing head 43 to stop discharging of ink to the nail portion T and terminates the printing to the nail portion T. Further, when the printing operation is terminated, the control section 50 controls the display section 13 to display a notice of the termination in the display section 13.

In such way, in this embodiment, the control section 50 functions as a print control device which controls the printing section 40 which is a printing device according to the detection result by the plate switch 652 which is a disjunction detection device.

Here, in this embodiment, the apparatus can handle both of the case where one finger of one hand (thumb of right hand, for example) is the printing finger U1 and the case where a plurality of fingers, such as a plurality of fingers of one hand (four fingers which are index finger, middle finger, ring finger and little finger of right hand, for example) or fingers of both hands (thumbs of both hands, for example) are the printing fingers U1.

In the case where a plurality of fingers are the printing fingers U1, when it is detected that the printing finger U1 is contacting the abutment member 650 in all of the plate switches 652 respectively provided in the finger insertion members 61 in which the printing fingers U1 are inserted (that is, when ON signals are outputted from all of the plate switches 652), the control section 50 controls the printing section 40 which is a printing device to start printing operation to the nail portions T at the time when the contact is detection (at the time of receiving the ON signals) or after a predetermined time has elapsed after the contact is detected.

Moreover, when removing of the printing finger U1 from the abutment member 650 is detected by at least one of the plurality of plate switches 652 (that is, when OFF signal is output from any one of the plate switch 652) after the printing operation is started, the control section 50 controls the printing section 40 so as to stop the printing operation to the nail portions T.

Here, other configurations are similar to that in the first embodiment. Therefore, same reference numerals are used for the similar parts and the descriptions are omitted.

Next, operations in this embodiment will be described with reference to FIGS. 19 and 20 and FIGS. 21A to 21C.

When performing printing to the nail portions T of printing fingers U1, a user first operates the operation button 121 and turns on the power of the nail print apparatus 1, and then, selects a nail image pattern (design) which the user desires to print on the nail portions T of the printing finger U1. It is preferred that the selected nail image pattern is displayed in the display section 13 as a thumbnail image for design confirmation.

Figure 19:
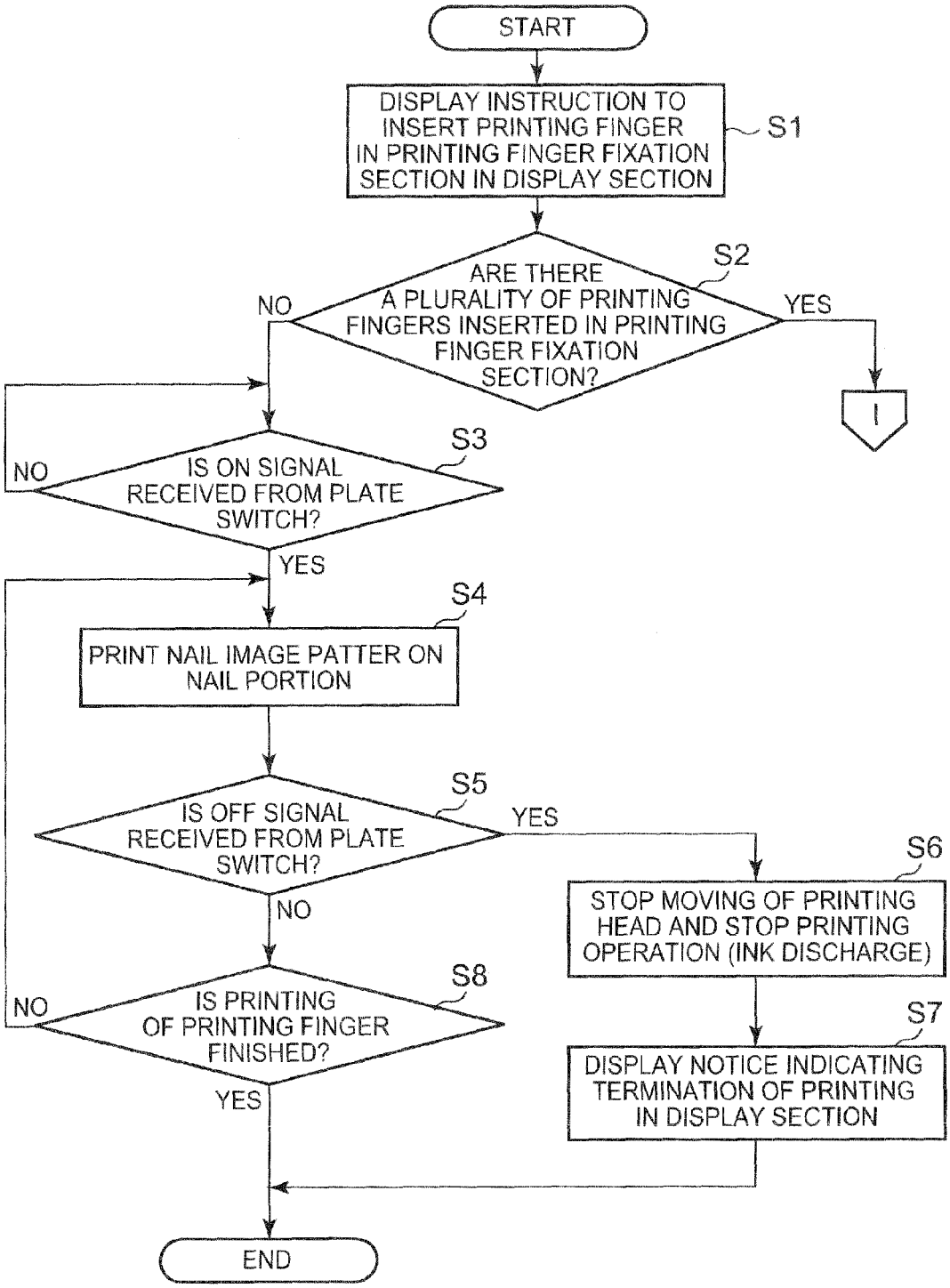
FIG. 19 is a flowchart showing a printing process of the nail print apparatus of the forth embodiment.

When a nail image pattern is selected, an instruction screen which instructs the user to insert printing fingers U1 into the printing finger fixation section 20 is displayed on the display section 13 (step S1 in FIG. 19).

When the user inserts the printing fingers U1 in the printing finger fixation unit 60 of the printing finger fixation section 20 according to the instruction, the control section 50 determines whether a plurality of printing fingers U1 are inserted in the printing finger fixation section 20 and also determined into which finger insertion members 61 the printing fingers U1 are inserted (step S2).

In particular, for example, when the user inserts the thumb of left hand in to the finger insertion member 61 of far left in the printing finger fixation section 20, the control section 50 determines that the printing finger U1 is inserted only in the finger insertion member 61 of far left among the four finger insertion members 61.

Moreover, for example, when the user inserts the little finger in the finger insertion member 61 of far left in the printing finger fixation unit 60, the ring finger in the finger insertion member 61 on the right for one slot, the middle finger in the finger insertion member 61 on the right for two slots and the index finger in the finger insertion member 61 of far right, succeeding from the far left finger insertion member 61, the control section 50 determines that the printing finger U1 is inserted in all of the four finger insertion members 61.

Here, the method for the control section 50 to determine the insertion state of the printing fingers U1 is not specifically limited. For example, the insertion state of the printing fingers U1 can be photographed by the photographing section 30 and transmitted to the control section 50, and the control section 50 can determine the insertion state of the printing fingers U1 based on the photographed image.

Further, for example, a sensor for detecting insertion of printing finger U1 can be provided at each finger insertion members 61, the cover member 62 or the like of the printing finger fixation section 20 and the control section 50 can determine the insertion state of printing fingers U1 based on the detection result of the sensor.

Moreover, a user can select and set to which finger insertion members the printing fingers U1 are to be inserted in advance and the control section 50 can determine the insertion state of printing fingers U1 based on the setting result.

When the control section 50 determines that one printing finger U1 is inserted in the finger insertion member 61 (step S2; NO, for example, when the control section 50 determines that a printing finger U1 is inserted only in the finger insertion member 61 of far left among the four finger insertion members 61), the control section 50 further determines whether ON signal from the plate switch 655 provided in the relevant finger insertion member 61 is received (step S3).

Figure 21A:
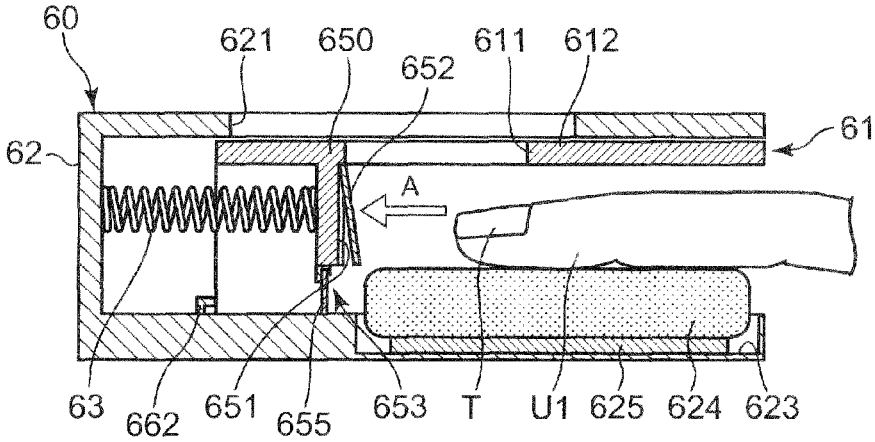
FIG. 21A is a sectional side view of the printing finger fixation unit shown in FIG. 15, wherein a printing finger is being inserted.
Figure 21B:
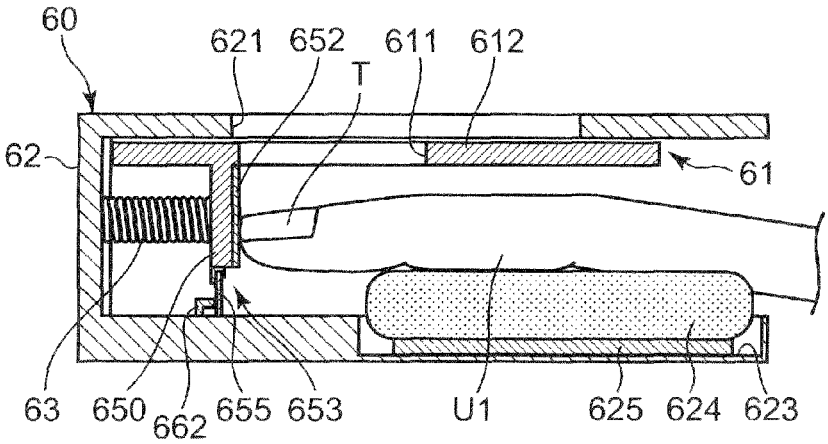
FIG. 21B is a sectional side view of the printing finger fixation unit shown in FIG. 15, wherein tip of the printing finger is pushing a plate switch.

In this embodiment, as shown in FIG. 21A, the plate switch 655 is in OFF state in which the free end thereof is raised from the abutment member 650 until the printing finger U1 pushes in the plate switch 655 to the abutment member 650. When a user inserts the printing finger U1 in the finger inserting direction A while pushing the abutment member 650 of the finger insertion member 61 with the tip of the printing finger U1, the finger insertion member 61 is pushed to the back side in the finger inserting direction A while pushing and shrinking the position recovery spring 63 and slides to a great extent in the finger inserting direction A. At this time, free end of the stopper member 655 smoothly moves in the finger inserting direction A while going over the concavo-convex section 661 on the bottom of the cover member 62. Then, when the printing finger U1 is inserted to the position according to its length, sliding of the finger insertion member 61 stops and the printing finger U1 firmly abuts the abutment member 650 which is pushed toward front side from the backside in the finger inserting direction A by the position recovery spring 63, and as shown in FIG. 21B, the plate switch 655 is pushed in by the tip of the printing finger U1. In such way, when the free end side of the plate switch 655 contacts the abutment member 650 (the concave 651 of the abutment member 650 in this embodiment), ON signal is output to the control section 50 from the plate switch 655.

When ON signal from the plate switch 655 is not received (step S3, NO), the control section 50 repeats the determination of step S3.

On the other hand, when ON signal from the plate switch 655 is received (step S3; YES), the control section 50 controls the printing section 40 and the printing operation to perform printing of the nail image patter on the nail portion T is carried out (step S4).

After the printing operation by the printing section 40 is started, the control section 50 constantly determines whether OFF signal from the plate switch 655 is received or not (step S5).

When OFF signal from the plate switch 655 is received (step S5; YES), the control section 50 controls the printing section 40 and stops the moving of the printing head 46 and stops the printing operation (discharging of ink from the printing head 46) and terminates the printing (step S6). Further, a notice indicating that the printing is terminated is displayed in the display section 13 (step S7), and the printing process to the nail portion T ends.

Here, when the finger insertion member 61 is pushed back in the opposite direction of the finger inserting direction A by the position recovery spring 63 when the printing finger U1 moves toward front side from the back side in the finger inserting direction A, removing of the printing finger U1 from the plate switch 655 cannot be detected because the finger insertion member 61 follows the movement of the printing finger U1. With respect to this aspect, in this embodiment, the finger insertion member 61 is restricted from moving in the opposite direction of the finger inserting direction A by the stopper mechanism 653 as a reserve movement restriction member. Therefore, the finger insertion member 61 does not follow the movement of the printing finger U1 and the plate switch 655 is removed from the abutment member 650 when the printing finger U1 moves toward from side from the back side in the finger inserting direction A. Thus, removing of the printing finger U1 from the plate switch 655 can be detected.

On the other hand, when OFF signal from the plate switch 655 is not receivers (step S5; NO), the control section 50 constantly determines whether printing to the nail portion T of the printing finger U1 is finished or not (step S8). When the control section 50 determines that the printing is not finished (step S8; NO), the processes of steps S4 to S8 are repeated. Further, when the control section 50 determines that the printing is finished (step S8; YES), the control section ends the printing process by the printing section 40.

Figure 20:
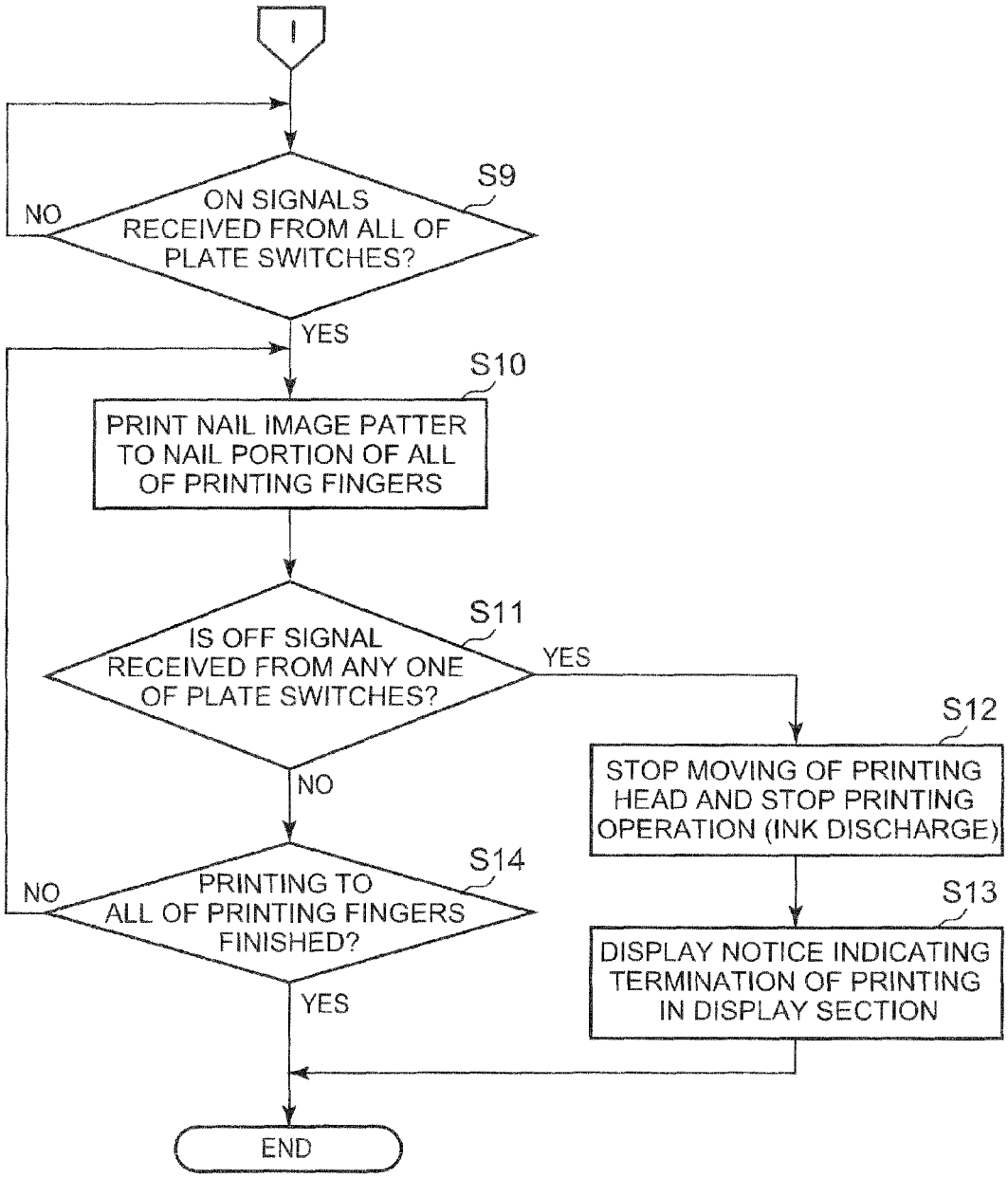
FIG. 20 is a flowchart showing a printing process of the nail print apparatus of the forth embodiment in a case where printing is to be performed to a plurality of printing fingers.

On the other hand, when the control section 50 determines that a plurality of printing fingers U1 are respectively inserted in the finger insertion members 61 (step S2 of FIG. 19; YES, for example, when four printing fingers U1 which are index finger to little finger are respectively inserted in the four finger insertion members 61), as shown in FIG. 20, the control section 50 further determines whether ON signal is received from all of the plate switches 655 respectively provided in the finger insertion members 61 in which the printing fingers U1 are respectively inserted (step S9).

Here, the configuration of outputting ON signals from the plate switches 655 to the control section 50 is similar to the case where printing is performed to only one finger. Therefore, the description is omitted.

When ON signals from all of the plate switches 655 are not received (step S9; NO), the control section repeats the determination of step S9.

On the other hand, when ON signals from all of the plate switches 655 are received (step S9; YES), the control section 50 controls the printing section 40 and printing operation to sequentially perform printing of a nail image pattern to all of the nail portions T of the printing fingers U1 is carried out (step S10).

After the printing operation by the printing section 40 is started, the control section 50 constantly determines whether OFF signal from any one of the plate switches 655 is received or not (step S11).

When OFF signal from any one of the plate switches 655 among the plurality of plate switches 655 is received (step S11; YES), the control section 50 controls the printing section 40 and stops the moving of the printing head 46 and stops the printing operation (discharging of ink from the printing head 46) and terminates the printing (step S12). Further, a notice indicating the termination of printing is to be displayed in the display section 13 (step S13) and the printing process to the nail portions T ends.

Here, the configuration of outputting OFF signal from the plate switch 655 to the control section is similar to the case where printing is carried out to only one finger. Therefore, the description is omitted.

On the other hand, when OFF signal from the plate switch 655 is not received (step S11; NO), the control section 50 constantly determines whether the printing to the nail portions T of all of the printing fingers U1 is finished or not (step S14). When the control section 50 determines that the printing is not finished (step S14; NO), the processes from step S10 to S14 are repeated. Further, when the control section 50 determines that the printing is finished (step S14; YES), the control section 50 ends the printing process by the printing section 40.

Here, other aspects are similar to those in the case where the printing is performed to only one finger. Therefore, the descriptions are omitted.

Figure 21C:
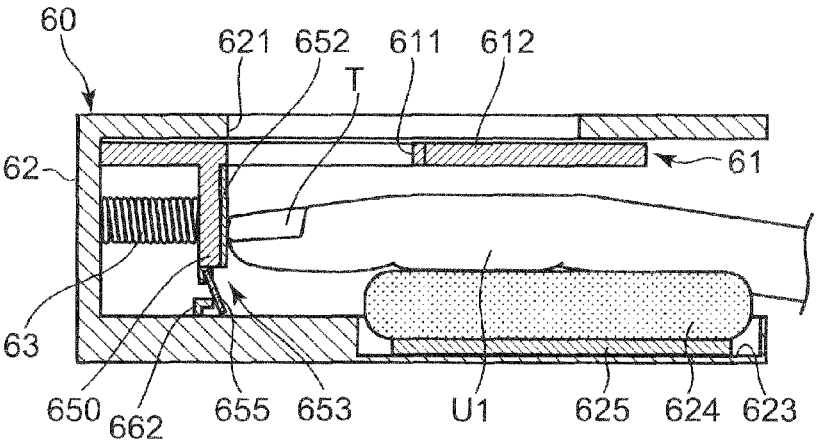
FIG. 21C is a sectional side view of the printing finger fixation unit shown in FIG. 15, wherein the stopper member is released by the restriction release member.

In both cases of one printing finger and a plurality of printing fingers, when OFF signal is outputted from a plate switch 655 and the printing is terminated or when the printing to the nail portions T is finished, free end side of the stopper member 655 of the stopper mechanism 653 abuts the restriction release member 662 and is lifted upward for a predetermined amount (upper direction in FIG. 21 or the like) as shown in FIG. 21C when a user inserts the printing fingers U1 deeply in the finger inserting direction A. When the free end side of the stopper member 655 is pushed up for the predetermined amount or more, free rotation of the stopper member 655 is restricted by the friction force and the turned state in which the free end is lifted up is maintained when the nonskid processed section 658 of the stopper member 655 contacts the inner surface of the stopper supporting member 654 (see FIG. 17C, for example). In such state, by a user pulling out the printing fingers U1 from the finger insertion members 61, each finger insertion member 61 is pushed back to its original position by the position recovery spring 63.

Here, when printing is to be performed next time, the free end of the stopper member 655 which is in the turned state is to return to the original position by a user pushing with her/his finger or the like. Here, the configuration may be such that a member to push back the free end of the stopper member 655 to the back side in the finger inserting direction A is arranged at front side in the finger inserting direction A of the printing finger fixation section 20, and the free end of the stopper member 655 which is in the turned state automatically returns to the original position by the member when the finger insertion member 61 is pushed back to the original position by the position recovery spring 63.

Here, other aspects are similar to those in the first embodiment. Therefore, the descriptions are omitted.

As described above, according to this embodiment, following advantages in addition to the advantages described in the first embodiment and others can be obtained.

That is, in this embodiment, the plate switches 652 which are disjunction detection devices which detect disjunction of printing fingers U1 with respect to the abutment members 650 are included, and printing is started when ON signal is output from the plate switches 652 and the printing operation is terminated when OFF signal is output.

In such way, by setting the printing fingers U1 in the printing finger fixation section 20, insertion state of the finger for determining whether the printing fingers U1 are in a printable state can be detected. Therefore, even when the switch operation for print start cannot be performed in the operation section 12 or the like as in a case where printing is to be performed to fingers of both hands, the printing can be started appropriately.

Moreover, when the printing fingers U1 are removed from the set positions after the printing is started, the printing can be terminated immediately. Therefore, misprinting due the printing fingers moving, smears attaching to fingers and the like can be prevented appropriately.

Furthermore, the nail print apparatus 1 of this embodiment includes a plurality of finger insertion members 61. Therefore, printing can be performed to the nail portions T of a plurality of printing fingers U1 at the same time. Further, printing can be started after all of the printing fingers U1 are set to appropriate positions even when printing is to be performed to a plurality of printing fingers U1 because a plate switch 652 which is a disjunction detection device is provided in each of the finger insertion members 61 and the printing is to start when ON signals from all of the plate switches 652 are output. Furthermore, because the printing is terminated when OFF signal is outputted from even one plate switch 652 among a plurality of plate switches 652, misprinting to the printing fingers U1 which is shifted, smears being attached to nail portions, fingers and so forth and the like can be prevented surely.

Moreover, a stopper mechanism 653 as a reverse movement restriction member which restricts the finger insertion member 61 from moving in opposite direction of the finger inserting direction A when the finger insertion member 61 slides along the finger inserting direction A is provided at the abutment member 650 of each finger insertion member 61. Therefore, when the printing finger U1 is removed from the abutment member 650 after the printing is once started, the finger insertion member 61 is pushed back in the opposite direction of the finger inserting direction A by the pressure of the position recovery spring 63 and follows the movement of the printing finger U1, and thus prevents the plate switch 652 from being maintained in ON state.

Moreover, the restriction release member 662 which releases the stopper member 655 of the stopper mechanism 653 is provided on the bottom of the cover member 62 provided in the printing finger fixation section 20. Therefore, for example, by the stopper member 655 being release by the restriction release member 662 after the plate switch 652 is turned OFF, the finger insertion member 61 can move in the opposite direction of the finger inserting direction A by the pressure of the position recovery spring 63 without resistance, and thus, the finger insertion member 61 can return to its original initial position.

Here, in this embodiment, the configuration which includes the plate switches 652 as disjunction detection devices which detect disjunction of the printing finger U1 with respect to the abutment members 650 are described. However, the disjunction detection device is not limited to the plate switch 652.

It is preferred that the disjunction detection device be in ON state by being pushed with a certain strength and outputs ON signal, maintains to be in ON state while it is pushed, and be in OFF state when the pushed state is released and outputs OFF signal. However, a contact sensor which detects contact and non-contact of the printing finger U1 or the like can be applied. In such case, considering the time each printing finger U1 slides to the position corresponding to each finger length since the printing finger U1 abuts the abutment member 650, it is preferred that printing is to start after a predetermined time has elapsed after the disjunction detection device be in ON state.

Figure 22A:
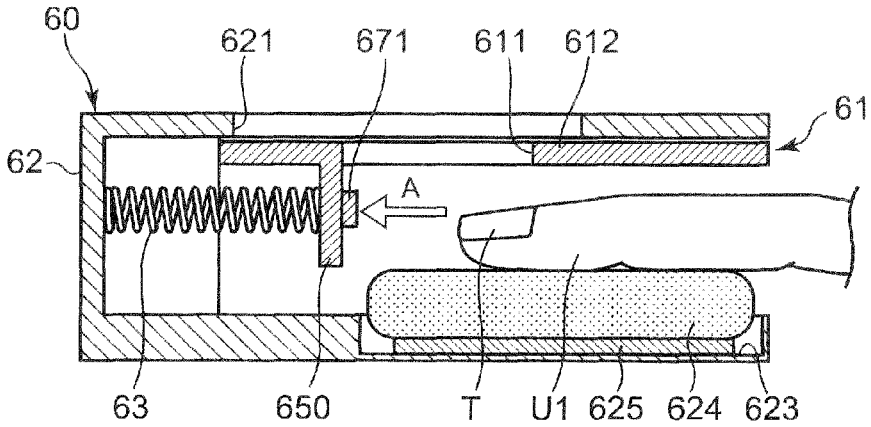
FIG. 22A is a sectional side view showing a modification example of the printing finger fixation unit shown in FIG. 21, wherein a printing finger is being inserted.
Figure 22B:
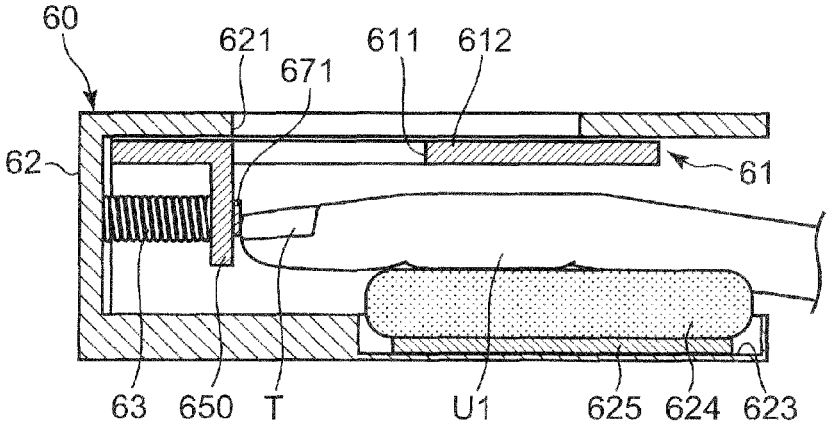
FIG. 22B is a sectional side view showing the modification example of the printing finger fixation unit shown in FIG. 21, wherein tip of the printing finger is pushing a tact switch.

As for another configuration of the disjunction detection device, for example, a push switch such as a tact switch 671 which be in ON state by being pushed by the tip portion of the printing finger U1 can be provided on the surface in the abutment member 650 in the side where the printing finger U1 abuts, as shown in FIGS. 22A and 22B. In such case, as shown in FIG. 22A, the tact switch 671 is in OFF state until the printing finger U1 contacts the abutment member 650 and pushes the tact switch 671. Then, as shown in FIG. 22B, when the tip portion of the printing finger U1 abuts the abutment member 650 and the tact switch 671 is pushed in, the tact switch 671 be in ON state and ON signal is output to the control section 50.

Figure 23A:
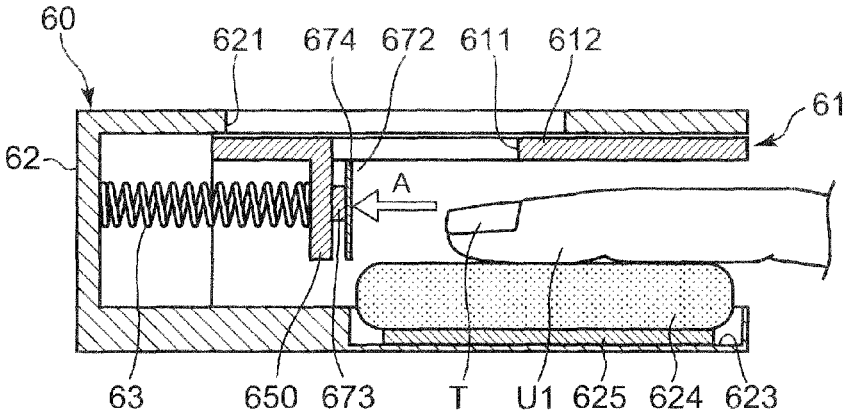
FIG. 23A is a sectional side view showing a modification example of the printing finger fixation unit shown in FIG. 21, wherein a printing finger is being inserted.
Figure 23B:
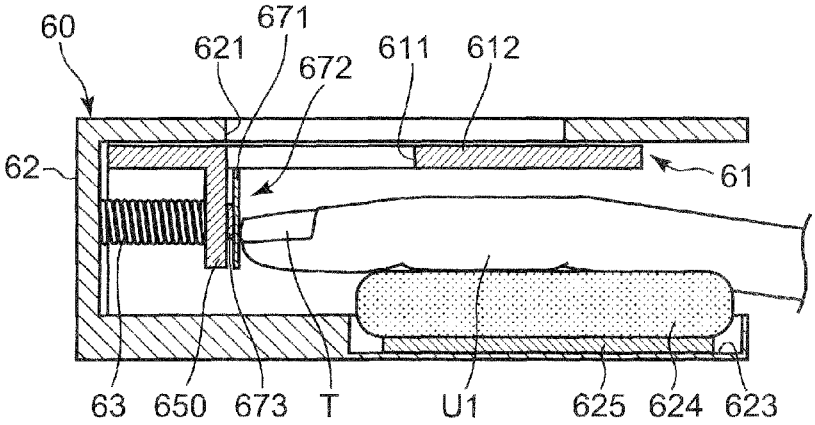
FIG. 23B is a sectional side view showing the modification example of the printing finger fixation unit shown in FIG. 21, wherein tip of the printing finger is pushing a tact switch of the switch mechanism.

Moreover, for example, a switch mechanism including a tact switch 673 which be in ON state by being pushed by the tip portion of the printing finger U1 in a similar manner as shown in FIGS. 22A and 22B and a plate member 674 which is arranged so as to be approximately parallel with the surface of the abutment member 650 in the side where the printing finger U1 abuts, the plate member 674 being provided on the front surface of the tact switch 673, can be provided on the surface of the abutment member 650 in the side where the printing finger U1 abuts, as shown in FIGS. 23A and 23B. In such case, as shown in FIG. 23A, the tact switch 673 remains to be in OFF state until the printing finger U1 contacts the abutment member 650 and pushed in the tact switch 673. Further, as shown in FIG. 23B, when the tip portion of the printing finger U1 abuts the abutment member 650 and the tact switch 673 is pushed in via the plate member 674, the tact switch 673 be in ON state and ON signal is output to the control section 50. In a case where the above configuration is applied, the pressing area for making the tact switch 673 be in ON state can be large. Therefore, the tact switch 673 can be made to be in ON state surely when the printing finger U1 is inserted in the finger insertion member 61.

Moreover, the positions where the disjunction detection devices such as the tact switches and the like are arranged are not limited to the above shown positions. For example, the disjunction detection devices can be disposed so as to be embedded in the abutment member 650 or can be disposed behind the abutment members 650.

Figure 24A:
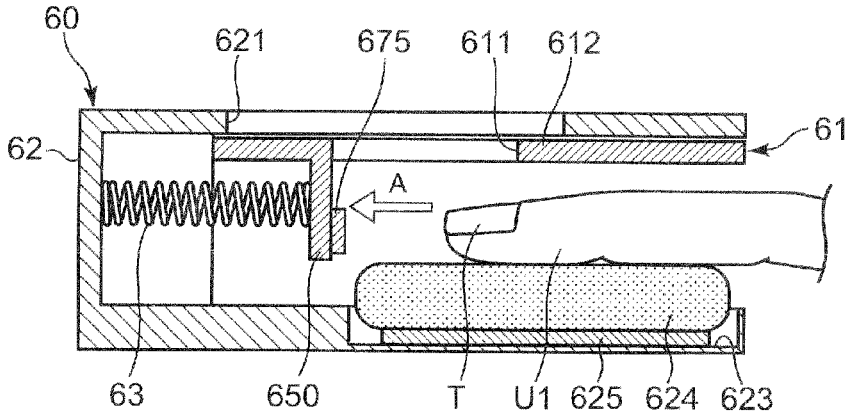
FIG. 24A is a sectional side view showing a modification example of the printing finger fixation unit shown in FIG. 21, wherein the printing finger is being inserted.
Figure 24B:
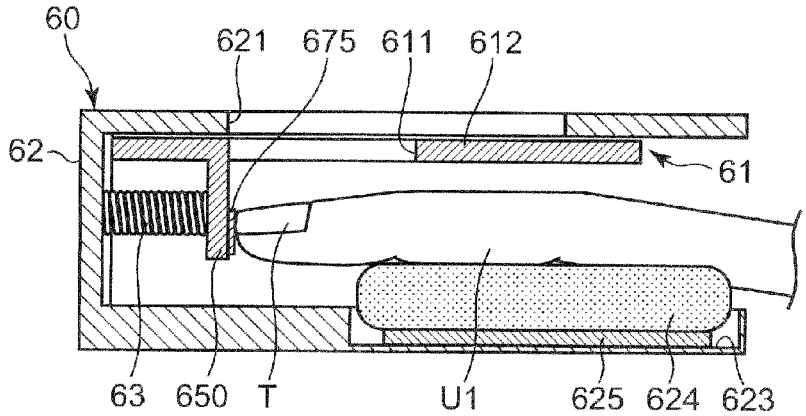
FIG. 24B is a sectional side view showing the modification example of the printing finger fixation unit shown in FIG. 21, wherein tip of the printing finger is pushing the tact switch.
Figure 24C:
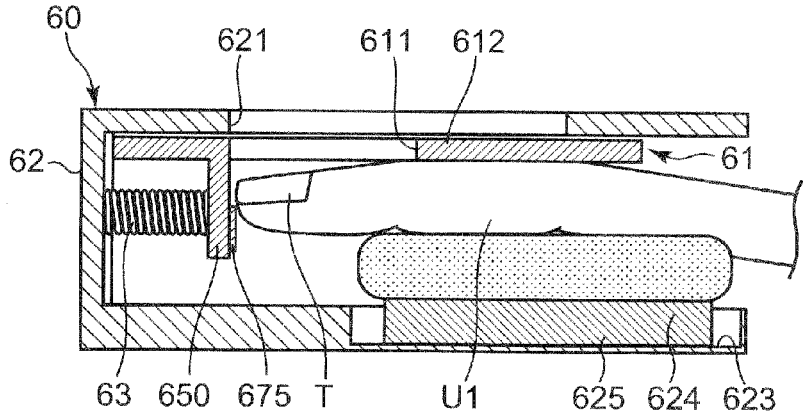
FIG. 24C is a sectional side view showing a modification example of the printing finger fixation unit shown in FIG. 21, wherein the finger placement member is lifted up by the lifting mechanism.

Here, because the finger placement members 624 are respectively lifted up by the lifting mechanisms 625 when printing is performed, there is a possibility that printing cannot be performed neatly to the tip of the nail portion T in the printing due to the tip portion of the nail portion T abutting the disjunction detection device in a case where the length of the nail portion T of the printing finger U1 is long, for example, when the disjunction detection device is arranged at the upper part of the abutment member 650. Therefore, for example, the tact switch 675 as a disjunction detection device can be provided toward lower side in the surface of the abutment member 650 in the side where the printing finger U1 abuts as shown in FIGS. 24A to 24C. In such case, as shown in FIG. 24A, the tact switch 675 be in OFF state until the printing finger U1 contacts the abutment member 650 and pushes the tack switch 675. Then, as shown in FIG. 24B, when the tip portion of the nail portion T of the printing finger U1 abuts the abutment member 650 and the tact switch 675 is pushed in, the tact switch be in ON state and ON signal is output to the control section 50. Thereafter, in a case where the above described configuration is applied, the nail portion T be above the tact switch 675 when the finger placement member 624 is lifted up, as shown in FIG. 24C. Therefore, the tact switch 675 does not interfere with printing and also, the nail portion T can be prevented from interfering with the abutment member 650, and thus, a fair printing can be performed to the tip of the nail portion T.

Figure 25A:
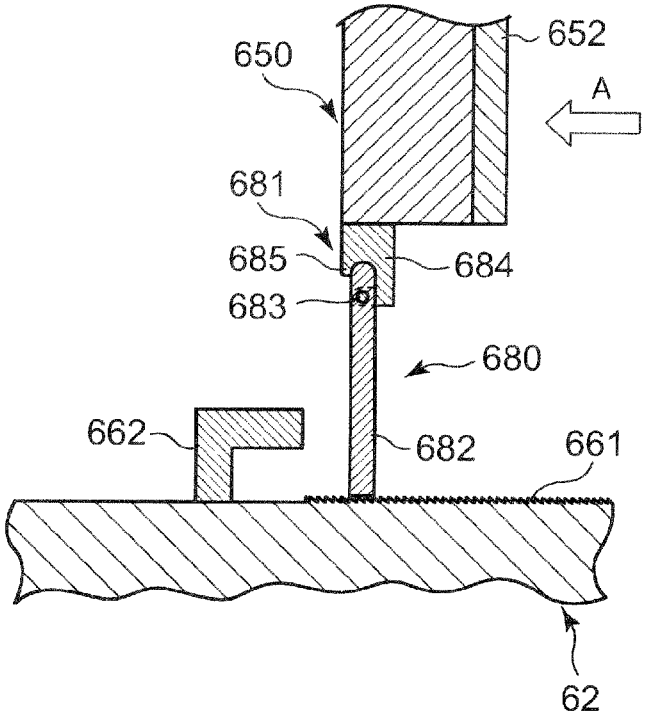
FIG. 25A is a sectional view showing a modification example of the stopper mechanism shown in FIG. 16, wherein movement is restricted by the stopper mechanism.

Moreover, configuration of the stopper mechanism and configuration of releasing the restriction by the stopper mechanism are not limited to what are shown in this embodiment, and other configurations can be applied. For example, as shown in FIGS. 25A and 25B, the stopper mechanism 680 can be configured by including a stopper supporting member 681 having an engaging protrusion 685 having elasticity toward back in the finger inserting direction A and a stopper member 682 which is shaft-supported by the rotation axis 683 to the stopper supporting member 681.

In a case where the above described configuration is applied, when the finger insertion member is pushed in to the back side in the finger inserting direction A, the fixed end side of the stopper member 682 is supported surely by the stopper supporting member 681 and the finger insertion member is prevented from being pushed back in the opposite direction of the finger inserting direction A by the friction force between the lower end portion (free end side) of the stopper member 682 and the concavo-convex section 661 of the cover member 62. Thus, the finger insertion member follows the movement of the printing finger U1 when the printing finger U1 is removed from the abutment member 650, and the plate switch 652 which is a disjunction detection device can be prevented from being maintained in ON state.

Figure 25B:
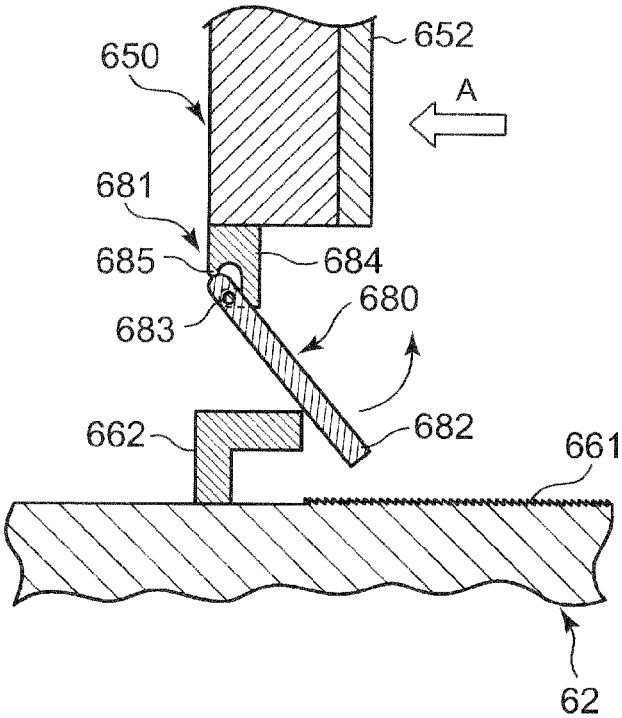
FIG. 25B is a sectional view showing a modification example of the stopper mechanism shown in FIG. 16, wherein the movement restriction by the stopper mechanism is released by the restriction release member.

Moreover, when releasing the restriction by the stopper mechanism, the lower end portion (fee end side) of the stopper member 682 abuts the restriction release member 662 and is lifted up in the direction shown by an arrow in FIG. 25B. In the configuration shown in FIGS. 25A and 25B, when the stopper member 682 turns for a predetermined amount or more in the arrow direction, the end portion of the stopper member 682 in the fixed side goes over the engaging protrusion 685 having elasticity and its turned state is maintained. In such way, the restriction on movement of the finger insertion member 61 by the stopper member 682 is released.

Here, the stopper mechanism 653, the restriction release member 662 and the like are not the required elements of the present invention, and the configuration may be such not including the above elements.

Moreover, in this embodiment, the concavo-convex section 661 is provided on the bottom of the cover member 62, and the stopper member 655 restricts moving of the finger insertion member 61 by the friction force between the lower end portion of the stopper member 655 and the concavo-convex section 611 in the cover member 62 side. However, it is not required to provide the concavo-convex section 661. In order to surely restrict moving of the finger insertion member 61 by the stopper member 655, it is preferred to perform some sort of surface process to the bottom surface of the cover member 62 for making the surface be nonskid. However, when the stopper member 655 is formed in a material which causes a great friction force or the like, it is not necessary to perform a nonskid process to the bottom of the cover member 62. Further, a spring or the like to press the stopper member 655 to the bottom direction of the cover member 62 can be provided and moving of the finger insertion member 61 can be restricted surely by pressing the stopper member 655 toward the bottom direction.

Moreover, in this embodiment, the finger insertion member 61 is made to stop at an appropriate position by the stopper mechanism. However, the finger insertion member 61 can be made to stop at a predetermined position.

In such case, when a plurality of printing fingers U1 are to be set, the finger insertion members 61 are locked when the longest printing finger U1 (usually, middle finger) among the plurality of printing fingers U1, for example, reaches a predetermined position. Here, "a predetermined position" is a position where the nail portion T of the longest printing finger U1 (for example, middle finger) is to be arranged in the back side in the printing range, and is a position where all of the other printing fingers U1 be in the printable range.

Moreover, in this embodiment, one apparatus can be used for performing printing to only one printing finger U1 and for performing printing to a plurality of printing fingers U1, and the configuration is such including a plurality of finger insertion members 61 and a disjunction detection device (a plate switch or a tact switch) is provided to each finger insertion member 61. However, the present invention can also be applied to an apparatus exclusive for performing printing to one printing finger U1 at a time.

Moreover, in this embodiment, the disjunction detection devices (a plate switch or a tact switch) are connected to the control section 50 which controls the printing section 40, ON signal/OFF signal output from the disjunction detection devices are transmitted to the control section 50, and the control section 50 controls so as to start printing and terminate printing when the signal is output from the disjunction detection device. However, the switching of the printing section 40 by the disjunction detection devices, such as printing start and terminating of printing, is not limited to the above configuration. For example, the disjunction detection devices can be directly connected to the first motor 43, the second motor 47, the printing head 46 and the like which constitute the printing section 40, and the disjunction detection devices can be made to function as a switch for turning ON/OFF the above directly.

As it is clearly shown from the above descriptions, the nail print apparatus (nail print apparatuses of FIG. 1 and so forth) according to the embodiments includes a printing finger fixation section (printing finger fixation section 20 in FIG. 2, for example) which fixes a printing finger (printing finger U1 in FIG. 2, for example) which is a finger of a nail portion (nail portion T in FIG. 2, for example) on which printing is to be performed and a printing section (printing section 40 in FIG. 2, for example) which performs printing to the nail portion of the printing finger which is fixed in the printing finger fixation section, and the printing finger fixation section includes at least on finger insertion member (finger insertion member 61 in FIG. 2, for example) which is provided so as to slide along a finger inserting direction according to a length of the printing finger when the printing finger is inserted, and the finger insertion member includes a nail portion exposure window (nail portion exposure window 611 of FIG. 2, for example) which is provided for exposing the nail portion in a side of the printing section, a finger pressing section (finger pressing section 612 of FIG. 2, for example) for pressing a vicinity of a base of the nail portion from above when the printing finger is inserted, the finger pressing section being disposed in a front side in the finger inserting direction (finger inserting direction A in FIG. 4, for example) than the nail portion exposure window and an abutment member (abutment member 613 in FIG. 2, for example) which is arranged in a back side in the finger inserting direction than the nail portion exposure window so that a tip portion of the printing finger abuts when the printing finger is inserted.

Preferably, the printing finger fixation section (printing finger fixation section 20 in FIG. 2, for example) includes a guide section (guide channels 622 in FIG. 6, for example) which guides the finger insertion member in a finger inserting direction (finger inserting direction A in FIG. 4, for example) of the printing finger to a position corresponding to the finger insertion member, when the printing finger (printing finger U1 in FIG. 2, for example) is inserted in the finger insertion member.

Preferably, the printing finger fixation section (printing finger fixation section 20 in FIG. 2, for example) further includes a cover member (cover member 82 of FIG. 12, for example) which houses at least one finger insertion member (finger insertion member 81 in FIG. 12, for example) and which has an opening (nail portion exposure opening 821 in FIG. 12, for example) at a position corresponding to the nail portion exposure window (nail portion exposure window 811 of FIG. 12, for example), and the guide section (guide channels 826 in FIG. 12, for example) is provided in the cover member.

Preferably, the nail print apparatus further includes a finger placement member (finger placement member 624 on FIG. 2, foe example) which holds the printing finger (printing finger U1 in FIG. 2, for example) inserted in the finger insertion member from below, and a lower side of the finger insertion member (finger insertion member 61 of FIG. 2, for example) is opened, and the finger placement member is arranged below the finger insertion member which has an opening.

Preferably, the nail print apparatus further includes a lifting mechanism (lifting mechanism 625 of FIG. 2, for example) which lifts up the finger placement member (finger placement member 624 of FIG. 2, for example) from below.

Preferably, the nail print apparatus further includes a photographing section (photographing section 30 of FIG. 2, for example) which obtains a finger nail image by photographing the printing finger (printing finger U1 of FIG. 2, for example) fixed in the printing finger fixation section (printing finger fixation section 20 of FIG. 2, for example) and a display section (display section 13 of FIG. 2, for example) which displays the finger nail image photographed by the photographing section.

Preferably, the nail print apparatus further includes a disjunction detection section (plate switch 652 of FIG. 15, for example) for detecting a disjunction of the printing finger with respect to the abutment member, the disjunction detection section being provided in an abutting side where the tip portion of the printing finger (printing finger U1 of FIG. 15, for example) abuts in the abutment member (abutment member 650 in FIG. 15, for example), a print control section (control section 50 of FIG. 18) which controls the printing section (printing section 40 of FIG. 15, for example) to start a printing operation to the nail portion by the printing section (at a time when a contacting of the printing finger and the abutment member is detected or when a predetermined time elapsed since the contacting of the printing finger and the abutment member is detected, when the contacting of the printing finger and the abutment member is detected by the disjunction detection section, and which controls the printing section (printing section 40 of FIG. 15, for example) to stop the printing operation to the nail portion when a removing of the printing finger from the abutment member is detected by the disjunction detection section after the printing operation is started.

Preferably, a plurality of finger insertion members (finger insertion members 61 of FIG. 15, for example) are provided corresponding to a plurality of printing fingers (printing fingers U1 of FIG. 15, for example), the disjunction detection section (plate switch 652 of FIG. 15, for example) is provided to each abutment member (abutment member 650 of FIG. 15, for example) in each of the plurality of finger insertion members, the printing control section (control section 50 of FIG. 18) controls the printing section (printing section 40 of FIG. 15, for example) so as to start the printing operation to the nail portion at the time when the contacting of the printing finger and the abutment member is detected or when the predetermined time elapsed since the contacting of the printing finger and the abutment member is detected, when the contacting of the printing finger which inserted in the finger insertion member and the abutment member is detected by the disjunction detection section, and controls the printing section (printing section 40 of FIG. 15, for example) so as to stop the printing operation to the nail portion when the removing of the printing finger from the abutment member is detected by at least one of the disjunction detection sections after the printing operation is started.

Preferably, the finger insertion member (finger insertion member 61 of FIG. 15, for example) includes a reverse movement restriction member (stopper mechanism 653 of FIG. 15, for example) which restricts the finger insertion member from moving in a direction opposite of the finger inserting direction (finger inserting direction A in FIG. 15, for example) when the finger insertion member slides along the finger inserting direction, and the printing finger fixation section (printing finger fixation section 20 of FIG. 15, for example) includes a restriction release member (restriction release member 662 of FIG. 15, for example) which releases the reverse movement restriction member.

With respect other aspects, the present invention is not limited to the above embodiment, and appropriate changes can be made.

Various embodiments of the present invention are described. However, the above described embodiments do not limit the scope of the present invention in any way and the scope of the invention recited in claims and the equivalents thereof are included.

The present U.S. patent application claims a priority under the Paris Convention of Japanese paten application No. 2010-275258 filed on Dec. 10, 2010 and Japanese patent application No. 2011-079684 filed on Mar. 31, 2011, which shall be a basis of correction of an incorrect translation.

What is claimed is:

1. A nail print apparatus, comprising:

a printing finger fixation section which fixes a printing finger which is a finger having a nail portion on which printing is to be performed; and a printing section which performs printing to the nail portion of the printing finger which is fixed in the printing finger fixation section;

wherein the printing finger fixation section comprises:

at least one finger insertion member which is provided so as to slide along a finger inserting direction according to a length of the printing finger when the printing finger is inserted; and a finger placement member which is arranged below the finger insertion member, wherein a lower side of the finger insertion member is open, and wherein the finger placement member holds the printing finger inserted in the finger insertion member from below; and wherein the finger insertion member comprises a nail portion exposure window which is provided for exposing the nail portion at a side of the printing section;

a finger pressing section for pressing a vicinity of a base of the nail portion from above when the printing finger is inserted, the finger pressing section being disposed at a front side in the finger inserting direction with respect to the nail portion exposure window; and an abutment member which is arranged at a back side in the finger inserting direction with respect to the nail portion exposure window so that a tip portion of the printing finger abuts the abutment member when the printing finger is inserted.

2. The nail print apparatus as claimed in claim 1, wherein the printing finger fixation section comprises a guide section which guides the finger insertion member in an inserting direction of the printing finger to a position corresponding to the finger insertion member, when the printing finger is inserted in the finger insertion member.

3. The nail print apparatus as claimed in claim 2, wherein the printing finger fixation section further comprises a cover member which houses at least one finger insertion member and which has an opening at a position corresponding to the nail portion exposure window, and the guide section is provided in the cover member.

4. The nail print apparatus as claimed in claim 1, further comprising a lifting mechanism which lifts up the finger placement member from below.

5. The nail print apparatus as claimed in claim 1, further comprising:

a photographing section which obtains a finger nail image by photographing the printing finger fixed in the printing finger fixation section; and a display section which displays the finger nail image photographed by the photographing section.

6. The nail print apparatus as claimed in claim 1, further comprising:

a disjunction detection section for detecting a disjunction of the printing finger with respect to the abutment member, the disjunction detection section being provided at an abutting side where the tip portion of the printing finger abuts the abutment member; and a print control section which controls the printing section to start a printing operation to the nail portion by the printing section at a time when a contacting of the printing finger and the abutment member is detected or when a predetermined time has elapsed since the contacting of the printing finger and the abutment member is detected, when the contacting of the printing finger and the abutment member is detected by the disjunction detection section, and which controls the printing section to stop the printing operation to the nail portion when a removing of the printing finger from the abutment member is detected by the disjunction detection section after the printing operation is started.

7. The nail print apparatus as claimed in claim 6, wherein:

a plurality of finger insertion members are provided corresponding to a plurality of printing fingers, the disjunction detection section is provided to each abutment member in each of the plurality of finger insertion members, and the printing control section controls the printing section so as to start the printing operation to the nail portion at the time when the contacting of the printing finger and the abutment member is detected or when the predetermined time has elapsed since the contacting of the printing finger and the abutment member is detected, when the contacting of the printing finger inserted in the finger insertion member and the abutment member is detected by the disjunction detection section, and controls the printing section so as to stop the printing operation to the nail portion when the removing of the printing finger from the abutment member is detected by at least one of the disjunction detection sections after the printing operation is started.

8. The nail print apparatus as claimed in claim 6, wherein the finger insertion member comprises a reverse movement restriction member which restricts the finger insertion member from moving in a direction opposite of the finger inserting direction when the finger insertion member slides along the finger inserting direction, and the printing finger fixation section comprises a restriction release member which releases the reverse movement restriction member.

9. A nail print apparatus, comprising:

a printing finger fixation section which fixes a printing finger which is a finger having a nail portion on which printing is to be performed; and a printing section which performs printing to the nail portion of the printing finger which is fixed in the printing finger fixation section;

wherein the printing finger fixation section comprises:

at least one finger insertion member which is provided so as to slide along a finger inserting direction according to a length of the printing finger when the printing finger is inserted; and a finger placement member which is arranged below the finger insertion member, wherein a lower side of the finger insertion member is open, and wherein the finger placement member holds the printing finger inserted in the finger insertion member from below; and wherein the finger insertion member comprises a nail portion exposure window which is provided for exposing the nail portion at a side of the printing section; and a finger pressing section for pressing a vicinity of a base of the nail portion from above when the printing finger is inserted, the finger pressing section being disposed at a front side in the finger inserting direction with respect to the nail portion exposure window.

10. The nail print apparatus as claimed in claim 9, wherein the printing finger fixation section comprises a guide section which guides the finger insertion member in an inserting direction of the printing finger to a position corresponding to the finger insertion member, when the printing finger is inserted in the finger insertion member.

11. The nail print apparatus as claimed in claim 10, wherein the printing finger fixation section further comprises a cover member which houses at least one finger insertion member and which has an opening at a position corresponding to the nail portion exposure window, and the guide section is provided in the cover member.

12. The nail print apparatus as claimed in claim 9, further comprising a lifting mechanism which lifts up the finger placement member from below.

13. The nail print apparatus as claimed in claim 9, further comprising:

a photographing section which obtains a finger nail image by photographing the printing finger fixed in the printing finger fixation section; and a display section which displays the finger nail image photographed by the photographing section.

* * * * *